US005687481A

United States Patent [19]

De Boer et al.

[11] Patent Number: 5,687,481

[45] Date of Patent: Nov. 18, 1997

[54] SHAVING APPARATUS WITH ELECTRICALLY ADJUSTABLE CUTTING UNIT

[75] Inventors: Jan De Boer; Jacobus N. Dekker; Andries T. Reeder; Albertus J. C. Van Der Borst; Pieter De Pooter, all of Drachten, Netherlands

[73] Assignee: U.S. Philips Corporation, New York, N.Y.

[21] Appl. No.: 455,613

[22] Filed: May 31, 1995

[30] Foreign Application Priority Data

Jun. 1, 1994 [EP] European Pat. Off. ..... 94201557

[51] Int. Cl.[6] ..... B26B 19/14

[52] U.S. Cl. ..... 30/43.1; 30/43.6

[58] Field of Search ..... 30/43.6, 43.9, 30/43.92, 43.1, 43.2, 346.51

[56] References Cited

FOREIGN PATENT DOCUMENTS 0386999 9/1990 European Pat. Off. .
0231966 10/1990 European Pat. Off. .
0484795 5/1992 European Pat. Off. .

*Primary Examiner*—Douglas D. Watts
*Attorney, Agent, or Firm*—Ernestine C. Bartlett; Norman N. Spain

[57] ABSTRACT

A shaving apparatus (1, 105) with at least one adjustable cutting unit (11, 121) which comprises an external cutting member (13, 123) with at least one hair trap opening (17) and an internal cutting member (19, 125) which is rotatable inside the external cutting member (13, 123) by means of an electric motor (23, 127). The cutting unit (11, 121) is adjustable by means of an electrical actuator (91, 179) which is controllable by an electrical control unit (103, 191).

In a first embodiment of the shaving apparatus (1), the external cutting member (13, 123) can be positioned relative to a holder (17) during a shaving operation by means of the actuator (91). In a second embodiment of the shaving apparatus (105), the external cutting member (123) is displaceable relative to the holder (111) under the influence of a skin contact force against a pretensioning force which has a value which is adjustable by means of the actuator (179). In both embodiments, the motor (23, 127) has a speed which is controlled by the control unit (103, 191).

The control unit (103, 191) adjusts the cutting unit (11, 121) and the motor speed (23, 127) as a function of a measured skin contact force, a measured cutting frequency, a time which has elapsed during a shaving operation, and a balance between shaving performance and shaving comfort desired by the user. In a special embodiment, the control unit (103, 191) controls the cutting unit (11, 121) and the motor speed in accordance with an algorithm based on fuzzy logic.

The shaving apparatus (1, 105) provides a user of the shaving apparatus (1, 105) with an optimum balance between the achieved shaving performance, i.e. skin smoothness and shaving speed, and the experienced shaving comfort, i.e. skin irritation level, during a shaving operation.

59 Claims, 17 Drawing Sheets

| inputs | | output |
|---|---|---|
| $U_F$ | $U_D$ | $U_H.U_E$ |
| L | L | 5 |
| | L/M | 6 |
| | M | 7 |
| | M/H | 8 |
| | H | 9 |
| H | L | 1 |
| | L/M | 2 |
| | M | 3 |
| | M/H | 4 |
| | H | 5 |

FIG.12A

| inputs | | output |
|---|---|---|
| $U_I$ | $U_R$ | $U_D$ |
| L | 1 | M |
| | 2 | L/M |
| | 3 | L |
| M | 1 | M/H |
| | 2 | M |
| | 3 | L/M |
| H | 1 | H |
| | 2 | L/M |
| | 3 | M |

FIG.12B

| inputs | | output |
|---|---|---|
| $U_{\%T}$ | $U_S$ | $U_I$ |
| B | P | L |
| | C | L |
| E | P | H |
| | C | M |

FIG.12C

| inputs | | output |
|---|---|---|
| $U_{\%T}$ | $U_M$ | $U_R$ |
| B | L | 2 |
| | H | 3 |
| E | L | 1 |
| | H | 3 |

FIG.12D

SHAVING APPARATUS WITH ELECTRICALLY ADJUSTABLE CUTTING UNIT

FIELD OF THE INVENTION

The invention relates to a shaving apparatus with at least one adjustable cutting unit which is provided with an external cutting member with at least one hair trap opening and an internal cutting member which is drivable relative to the external cutting member by means of an electric motor.

BACKGROUND OF THE INVENTION

A shaving apparatus of the kind mentioned in the opening paragraph is known from European Patent 0 231 966. The known shaving apparatus comprises three round cutting units arranged in a holder. The external curing members of the curing units are detachably fastened to a common plate. The internal cutting members are each rotatable by means of a separate coupling shaft, which can be driven by the motor, and rest in the corresponding external cutting members under the influence of an elastic pretensioning force acting on the individual coupling shafts. A slidable adjustment ring is provided along a circumference of the holder, which ring is provided with three projections pointing inwards. The common plate has three stepped cams with which the plate rests on the three projections of the adjustment ring under the influence of an elastic pretensioning force. Through shifting of the adjustment ring, it is possible to displace the common plate relative to the holder and to adjust a height over which the external cutting members project from the holder. If said height is comparatively small, the shaving comfort will be comparatively high, i.e. the skin irritation level will be comparatively low, whereas the shaving performance will be comparatively low, i.e. the speed of the shaving process and the achievable skin smoothness are comparatively low. If said height is comparatively great, the speed of the shaving process and the achievable skin smoothness are relatively high, but the skin irritation level is also comparatively high. A user of the known shaving apparatus may thus adjust a balance between the shaving comfort and the shaving performance desired by him through shifting of the adjustment ring.

A disadvantage of the known shaving apparatus is that an adjustment of the cutting units chosen by the user will be maintained during one or several shaving operations or will be changed only a very limited number of times. Since the shaving comfort and the shaving performance depend on a number of conditions such as, for example, the number of hairs per skin surface unit, the force with which the user presses the shaving apparatus against the skin, and the time which has elapsed during a shaving operation, and since these conditions vary strongly over one or several shaving operations, the adjustment of the cutting units chosen by the user does not provide the user with an optimum balance between the shaving performance and the shaving comfort experienced by the user during the shaving operation.

SUMMARY OF THE INVENTION

It is an object of the invention to provide a shaving apparatus of the kind mentioned in the opening paragraph with which the balance between the shaving performance and the shaving comfort experienced by the user during the shaving operation is improved.

The invention is for this purpose characterized in that the cutting unit is adjustable by means of an electrical actuator which is controllable by an electrical control unit. Since the cutting unit is adjustable by means of the electrical actuator, the adjustment of the cutting unit can be changed automatically during a shaving operation. The actuator can be controlled and the cutting unit can be adjusted through a suitable design of the control unit such that the user continuously experiences the shaving comfort desired by him during the shaving operation and the best possible shaving performance is provided in relation to this desired shaving comfort.

A special embodiment of a shaving apparatus according to the invention is characterized in that the cutting unit is arranged in a holder and is displaceable relative to the holder by means of the actuator. The user's skin rests on the external cutting member of the cutting unit and on the holder during shaving. The shaving performance and the shaving comfort experienced by the user are dependent on the deformation of the skin around the cutting unit, which deformation depends on the adjustment position of the cutting unit relative to the holder. If the actuator is controllable by means of a suitable control unit, a shaving comfort level desired by the user can be maintained during shaving in that displacements of the cutting unit are generated by the actuator, while an optimum shaving performance in relation to this desired shaving comfort is provided.

A further embodiment of a shaving apparatus according to the invention is characterized in that the actuator places the cutting unit in a rest position, in which the cutting unit is recessed in the holder, when the electric motor is switched off. The cutting unit is thus protected by the holder when the shaving apparatus is not in use, so that damage to the cutting unit through dropping of or impacts against the shaving apparatus is avoided as much as possible.

A yet further embodiment of a shaving apparatus according to the invention is characterized in that the external cutting member is displaceable relative to the holder by means of the actuator, while the internal cutting member is held in the external cutting member under the influence of a pretensioning force of an elastically deformable element. The use of said elastically deformable element causes the internal cutting member to remain in a desired position relative to the external cutting member during displacements of the external cutting member, so that the entire cutting element is displaceable in that exclusively the external cutting member is adjusted by the actuator.

A particular embodiment of a shaving apparatus according to the invention is characterized in that the external cutting member of the cutting unit is fastened to a displaceable carrier which is coupled to an adjustment member which is rotatable relative to the holder by means of the actuator, the carrier being displaceable through a rotation of the adjustment member. Owing to the use of the rotatable adjustment member, a simple, conventional electric motor may be used as the actuator by means of which the adjustment member can be driven into rotation. In a further embodiment of the shaving apparatus according to the invention, the carrier is a common carrier for at least two cutting units, while the actuator is a common actuator for the cutting units, so that a simple and effective construction of the shaving apparatus is provided. In a yet further embodiment of the shaving apparatus according to the invention, the carrier rests on a cam provided on the rotatable adjustment member under the influence of a further elastically deformable element. A transmission ratio obtaining between the actuator and the carrier is determined by a profile provided on the cam, while a suitable design of said profile leads to an accurate adjustability of the cutting element.

A further embodiment of a shaving apparatus according to the invention is characterized in that the electrical control unit has an electrical input which is connected to an electrical output of a position sensor which is capable of measuring a position of the cutting unit relative to the holder. Owing to the use of said position sensor, the control unit can detect a difference between an actual position of the cutting unit measured by the position sensor and a desired position of the cutting unit determined by the control unit. The measured position is rendered equal to the desired position in that the actuator is controlled in a suitable manner, so that an accurate adjustment of the cutting unit is provided.

A yet further embodiment of a shaving apparatus according to the invention is characterized in that the position sensor is capable of measuring an angle of rotation of the adjustment member relative to the holder. Since the angle of rotation through which the adjustment member has been rotated relative to the holder determines the position of the external cutting member relative to the holder, the position of the cutting unit can be measured in a simple and practical manner by means of said position sensor.

A special embodiment of a shaving apparatus according to the invention is characterized in that the cutting unit is arranged in a holder and is displaceable relative to the holder against a pretensioning force which has a value which is adjustable by means of the actuator. During shaving, the cutting unit is displaced relative to the holder under the influence of a force exerted on the shaving apparatus by the user. The shaving performance and the shaving comfort experienced by the user depend on a pressure exerted on the skin by the cutting unit, which pressure depends on said pretensioning force. If the actuator can be controlled by a suitable control unit, a shaving comfort desired by the user can be maintained during shaving through adjustment of the value of the pretensioning force by means of the actuator, and an optimum shaving performance can be achieved in relation to this desired shaving comfort.

A further embodiment of a shaving apparatus according to the invention is characterized in that the pretensioning force is exerted by an elastically deformable element which has a mechanical stiffness which is adjustable by means of the actuator. The cutting unit is displaceable relative to the holder over a limited distance only. Owing to the use of the elastically deformable element, the pressure exerted on the skin by the cutting unit and dependent on the pretensioning force is determined by the distance over which the cutting unit is displaced relative to the holder and by the value of the mechanical stiffness of said element. Since the mechanical stiffness of the elastically deformable element is adjustable, a wide range of adjustment values for the pretensioning force is achieved in spite of the limited displaceability of the cutting unit.

A yet further embodiment of a shaving apparatus according to the invention is characterized in that the elastically deformable element is coupled to the external cutting member, while the internal cutting member is held in the external cutting member under the influence of a pretensioning force of a further elastically deformable element. Coupling of the elastically deformable element to the external cutting member means that the pretensioning force is exerted directly on the external cutting member to be placed against the skin, while the internal cutting member remains in a desired position relative to the external cutting member during displacement of the external cutting member through the use of the further elastically deformable element.

A particular embodiment of a shaving apparatus according to the invention is characterized in that the elastically deformable element is a mechanical blade spring which can be supported by a support element which is displaceable by means of the actuator. The mechanical stiffness of the blade spring depends on an effective length of the blade spring, which effective length is substantially equal to the length of an elastically deformable portion of the blade spring and is determined by the position of the support element. The effective length and the mechanical stiffness of the mechanical blade spring are thus adjustable in a constructionally simple manner through displacement of the support element by means of the actuator.

A further embodiment of a shaving apparatus according to the invention is characterized in that the support element cooperating with the cutting unit is provided on a displaceable carrier which is coupled to an adjustment member which is rotatable relative to the holder by means of the actuator, the carrier being displaceable through a rotation of the adjustment member. Owing to the use of the rotatable adjustment member, the actuator may be a simple, conventional electric motor by means of which the adjustment member can be driven into rotation. A further embodiment of the shaving apparatus according to the invention comprises at least two cutting units, while the carrier is a common carrier for the support elements cooperating with the cutting units, so that the pretensioning force of the cutting units is adjustable by means of only one actuator, and a simple and effective construction of the shaving apparatus is achieved. In a yet further embodiment of the shaving apparatus according to the invention, the carrier rests on a cam provided on the rotatable adjustment member. A transmission ratio obtaining between the actuator and the carrier is determined by a profile provided on the cam, while an accurate adjustment possibility for the cutting elements is achieved through a suitable design of said profile.

A yet further embodiment of a shaving apparatus according to the invention is characterized in that the electrical control unit has an electrical input which is connected to an electrical output of a sensor capable of measuring the pretensioning force of the cutting unit. Owing to the use of the sensor, the control unit is capable of detecting a difference between an actual value of the pretensioning force measured by the sensor and a desired value of the pretensioning force determined by the control unit. The measured pretensioning force is rendered equal to the desired pretensioning force in that the actuator is controlled in a suitable manner, so that an accurate adjustment of the cutting unit is provided.

A special embodiment of a shaving apparatus according to the invention is characterized in that an angle of rotation of the adjustment member relative to the holder is measurable by means of the sensor, while a further electrical input of the control unit is connected to an electrical output of a further sensor capable of measuring a position of the cutting unit relative to the holder. Since the mechanical stiffness of the blade spring is determined by the position of the support element, which the position of the support element is determined by the angle of rotation of the adjustment member, the mechanical stiffness can be measured by means of the sensor. Since the pretensioning force of the cutting unit is determined by the value of the mechanical stiffness of the blade spring and by the position of the cutting unit relative to the holder, which is measurable by means of the further sensor, it is possible to measure the pretensioning force in a practical manner by means of said sensor, further sensor, and control unit.

A further embodiment of a shaving apparatus according to the invention is characterized in that the further sensor is a strain gauge sensor by means of which a deformation of a spring fastened between the external cutting member and the holder is measurable. Since the deformation of said spring is determined by the position of the external cutting member relative to the holder, the position of the external cutting member can be measured in a simple and practical manner by means of said further sensor.

A still further embodiment of a shaving apparatus according to the invention is characterized in that the electric motor has a speed which is controllable by means of the electrical control unit. A comparatively high motor speed is required for achieving a desired shaving performance in the case of a comparatively great number of hairs per unit skin surface, while the same shaving performance can be achieved at a comparatively low motor speed in the case of a comparatively small number of hairs per unit skin surface. Since the skin irritation level increases with an increasing speed of the internal cutting member, and the shaving comfort is thus dependent on the speed of the electric motor, the balance between shaving performance and shaving comfort is further improved in that the motor speed is controlled in a suitable manner by means of the electrical control unit.

A special embodiment of a shaving apparatus according to the invention is characterized in that the electrical control unit has an electrical input which is connected to an electrical output of an operational member with which a desired balance between shaving performance and shaving comfort can be set. A user of the shaving apparatus can adjust a balance between shaving performance, i.e. the speed of the shaving process and the skin smoothness to be achieved, and shaving comfort, i.e. the acceptable skin irritation level, desired by him by means of said operational member. This balance is achieved in that the control unit adjusts the cutting unit in a suitable manner during the shaving process.

A further embodiment of a shaving apparatus according to the invention is characterized in that the electrical control unit has an electrical input which is connected to an electrical output of a timer capable of measuring a time which has elapsed during a shaving operation. The use of the timer renders it possible for the control unit to control the cutting unit as a function of the time which has elapsed during a shaving operation. Since the conditions which influence the shaving performance and the shaving comfort experienced by the user change during a shaving operation, the balance between shaving performance and shaving comfort can be further improved in that the cutting unit is controlled in a suitable manner as a function of the time which has elapsed during a shaving operation.

A still further embodiment of a shaving apparatus according to the invention is characterized in that the control unit is provided with a calculation unit for calculating an average shaving time over a number of previous shaving operations, the control unit determining the time which has elapsed during a shaving operation in relation to the calculated average shaving time. Since the time which has elapsed during a shaving operation is determined in relation to the average shaving time, the cutting unit can be so controlled by the control unit that an optimum balance between a shaving performance and shaving comfort is achieved for the user, provided the shaving operation takes place in the average shaving time. Thus an optimum balance between shaving performance and shaving comfort is achieved both for users with a comparatively long average shaving time and for users with a comparatively short average shaving time.

A special embodiment of a shaving apparatus according to the invention is characterized in that the electrical control unit has an electrical input which is connected to an electrical output of a detector capable of measuring a number of hairs cut by the cutting unit per unit time. The use of said detector renders the cutting unit controllable by the control unit during a .shaving operation as a function of the number of hairs cut by the cutting unit per unit time, which number depends on the number of hairs per unit skin surface. Since the shaving performance and the shaving comfort experienced by the user depend on the number of hairs per unit skin surface, the balance between shaving performance and shaving comfort may be further improved by controlling the cutting unit in a suitable manner in dependence on the number of hairs cut by the cutting unit per unit time.

A further embodiment of a shaving apparatus according to the invention is characterized in that the detector is provided with a microphone capable of detecting an acoustic signal produced by the cutting unit, and with an electrical filter capable of filtering a cutting frequency from the acoustic signal. The cutting frequency measured by means of the microphone and the filter is the number of individual hair cut operations carried out by the cutting unit per unit time, i.e. the number of hairs which the cutting unit cuts per unit time. The detector constructed in this way is reliable and particularly suitable for incorporation in the limited space in the shaving apparatus.

A yet further embodiment of a shaving apparatus according to the invention is characterized in that the electrical control unit has an electrical input which is connected to an electrical output of a force sensor capable of measuring a skin contact force exerted on the cutting unit. Owing to the use of said force sensor, the cutting unit is controllable by the control unit during a shaving operation as a function of the skin contact force exerted on the cutting unit, which force is dependent on the force with which the user presses the shaving apparatus against the skin. Since the shaving performance and the shaving comfort experienced by the user depend on said skin contact force, the balance between shaving performance and shaving comfort can be further improved by controlling the cutting unit in a suitable manner in dependence on the measured skin contact force.

A particular embodiment of a shaving apparatus according to the invention is characterized in that the force sensor comprises a strain gauge sensor which is provided on an elastically deformable bridge, while the rotatable adjustment member rests on the bridge in a direction parallel to a force to be measured and has a mechanical stiffness in said direction which is comparatively small compared with a mechanical stiffness which the bridge has in said direction. A force can be measured by means of said strain gauge sensor which is exerted on the adjustment member by the carrier of the cutting unit. Since this force depends on the skin contact force exerted on the cutting unit, the skin contact force can be measured in a simple and practical manner by means of said strain gauge sensor.

A further embodiment of a shaving apparatus according to the invention is characterized in that the force sensor by which the skin contact force can be measured is the sensor by which the pretensioning force of the cutting unit can be measured. The force sensor thus has a dual function, whereby the number of sensors required is reduced.

A yet further embodiment of a shaving apparatus according to the invention is characterized in that the electrical control unit is provided with means for controlling the electrical actuator, with a first electrical input which is connected to an electrical output of the force sensor, a second electrical input which is connected to the electrical output of the timer, a third electrical input which is connected to the electrical output of the operational member, a fourth electrical input which is connected to the electrical output of the detector, and an electrical output for supplying an output signal which corresponds to a desired position of the cutting unit above the holder or a desired value of the pretensioning force of the cutting unit. Owing to the use of the four electrical inputs mentioned above, the cutting unit can be controlled by the actuator in dependence on the balance between shaving performance and shaving comfort desired by the user, the time which has elapsed during a shaving operation, the number of hairs per unit skin surface, and the skin contact force exerted on the cutting unit, so that the shaving performance and the shaving comfort are adapted to the wishes and features of the user of the shaving apparatus to a high degree.

A special embodiment of a shaving apparatus according to the invention is characterized in that said means determine the output signal in accordance with a first control rule according to which the desired position above the holder or the pretensioning force decreases when the measured skin contact force increases, and the desired position above the holder or the pretensioning force increases when an admissible skin deformation around the cutting unit increases, while said means determine the admissible skin deformation in accordance with a second control rule. The skin deformation around the cutting unit is determined by the value of the skin contact force and by the position of the cutting unit above the holder or the pretensioning force of the cutting unit. The skin deformation increases when the position above the holder or the pretensioning force increases at a constant skin contact force, or when the skin contact force increases at a constant position above the holder or constant pretensioning force. Since the admissible skin deformation is determined by the second control rule, the output signal corresponding to the desired position or pretensioning force of the cutting unit can be determined in a simple and practical manner by means of the first control rule as a function of the admissible skin deformation and the measured skin contact force.

A further embodiment of a shaving apparatus according to the invention is characterized in that, in accordance with the second control rule, the admissible skin deformation decreases when a desired speed of the motor increases, and the admissible skin deformation increases when an admissible number of skin damage points per unit time increases, while the means determine the admissible number of skin damage points per unit time in accordance with a third control rule and the desired motor speed in accordance with a fourth control rule. The number of skin damage points per unit time is determined by the deformation of the skin around the cutting unit and the speed of the internal cutting member, which is dependent on the motor speed. The number of skin damage points per unit time increases when the skin deformation around the cutting unit becomes greater at a constant motor speed, or when the motor speed increases at a constant skin deformation around the cutting unit. Since the admissible number of skin damage points per unit time is determined by the third control rule and the desired motor speed by the fourth control rule, the admissible skin deformation can be determined in a simple and practical manner by means of said second control rule as a function of the admissible number of skin damage points per unit time and the desired motor speed.

A yet further embodiment of a shaving apparatus according to the invention is characterized in that, in accordance with the third control rule, the admissible number of skin damage points per unit time increases with an increase in the time which has elapsed during a shaving operation, the increase in the admissible number of skin damage points per unit time being comparatively small if the operational member is in a position in which a user of the shaving apparatus wishes a comparatively high shaving comfort and comparatively low shaving performance, and being comparatively great if the operational member is in a position in which a user of the shaving apparatus desires a comparatively low shaving comfort and comparatively high shaving performance. The cutting unit mainly cuts long hairs during an initial phase of the shaving process, the elapsed time then being comparatively short. By allowing only a small number of skin damage points in the initial phase, during which the comparatively long hairs are shortened, a reserve is built up for skin damage still admissible in an end phase of the shaving process, during which a desired smoothness is to be achieved through further shortening of the hairs. If the user wants a comparatively high shaving performance and a comparatively low shaving comfort, a comparatively great number of skin damage points per unit time is allowed in accordance with the third control rule, so that in accordance with the second control rule a comparatively great skin deformation is allowed and according to the first control rule the cutting unit should be comparatively high above the holder or should have a comparatively strong pretensioning force. If the user wants a comparatively low shaving performance and a comparatively high shaving comfort, a comparatively small number of skin damage points per unit time is allowed according to the third control rule, so that according to the second control rule a comparatively small skin deformation is allowed, and according to the first control rule the curing unit should be comparatively low above the holder or should have a comparatively weak pretensioning force.

A special embodiment of a shaving apparatus according to the invention is characterized in that, according to the fourth control rule, the desired motor speed increases with an increase in the measured number of hairs cut by the cutting unit per unit time, the desired motor speed decreases when the time which has elapsed during a shaving operation increases, and the increase in the desired motor speed with an increase in the measured number of hairs cut by the cutting unit per unit time is comparatively small if the elapsed time is short, and is comparatively great if the elapsed time is long. If the number of hairs cut by the cutting unit per unit time (hair supply) is comparatively great, the internal cutting member is displaced relative to the external cutting member under the influence of the cutting forces which occur. The displacement of the internal cutting member relative to the external cutting member impairs the shaving performance. An increase in the motor speed at an increase in the hair supply renders the position of the internal cutting member in the external cutting member more stable, i.e. this position is less disturbed and the shaving performance is less impaired. Since the increase in the desired motor speed with an increase in the measured number of hairs cut by the cutting unit per unit time is comparatively great if the elapsed time has been comparatively long, the needs of so-called local shavers are taken into account, i.e. of users who shave a portion of the skin until smooth each time and subsequently move to a yet unshaven portion.

A further embodiment of a shaving apparatus according to the invention is characterized in that said means are provided with a further electrical output for supplying a further output signal which corresponds to the desired motor speed determined in accordance with the fourth control rule. Thus the control unit controls both the adjustment of the cutting unit and the speed of the motor as a function of the balance between shaving performance and shaving comfort desired by the user, the time which has elapsed during a shaving operation, the number of hairs per unit skin surface, and the skin contact force exerted on the cutting unit.

A yet further embodiment of a shaving apparatus according to the invention is characterized in that the electrical control unit is provided with means for controlling the speed of the electric motor, with a first electrical input connected to the electrical output of the timer, a second electrical input connected to the electrical output of the detector, and an electrical output for supplying an output signal which corresponds to a desired motor speed and which is determined by a control rule. The control of the motor speed by said means is not directly dependent on the control to be used for the actuator which is to adjust the cutting unit. The said means for controlling the motor speed may thus be applied in combination with alternative means for controlling said actuator.

A special embodiment of a shaving apparatus according to the invention is characterized in that, in accordance with the control rule, the desired motor speed increases with an increase in the measured number of hairs cut by the cutting unit per unit time, the desired motor speed decreases as the time elapsed during a shaving operation increases, and the increase in the desired motor speed with an increase in the measured number of hairs cut by the cutting unit per unit time is comparatively small if the elapsed time is short, and comparatively great if the elapsed time is long. If the number of hairs cut by the cutting unit per unit time (hair supply) is comparatively great, the internal cutting member is displaced relative to the external cutting member under the influence of the cutting forces which occur. The displacement of the internal cutting member relative to the external cutting member impairs the shaving performance. By increasing the motor speed with an increase in the hair supply, the position of the internal cutting member in the external cutting member becomes more stable, i.e. this position is less disturbed by the cutting forces occurring, and the shaving performance is less impaired. Since the increase in the desired motor speed with an increase in the measured number of hairs cut by the cutting unit per unit time is comparatively great if the elapsed time period is comparatively long, the needs of so-called local shavers are taken into account, i.e. of users who shave a portion of the skin until smooth each time and subsequently move to an as yet unshaven portion.

A further embodiment of a shaving apparatus according to the invention is characterized in that the control rules determine the output signal in accordance with an algorithm based on fuzzy logic. According to the algorithm based on fuzzy logic, a range of each input quantity for each control rule is subdivided into a number of classes, and a membership of one of the classes is assigned to an instantaneous input quantity in accordance with a membership function. The output quantity of the control rule is determined in accordance with a logic rule as a function of a membership of the input quantities ascertained in accordance with the membership function. A desired behaviour of the shaving apparatus as a function of the input quantities can thus be laid down in the control rules in a simple manner. In addition, the desired behaviour of the shaving apparatus can be changed in a simple and flexible manner in a design phase if the knowledge of or insight into the operation of the shaving apparatus changes or if new input or output quantities are desired.

BRIEF DESCRIPTION OF THE DRAWINGS

The invention will be explained in more detail below with reference to the drawing, in which.

DESCRIPTION OF THE PREFERRED EMBODIMENTS

Figure 1A:
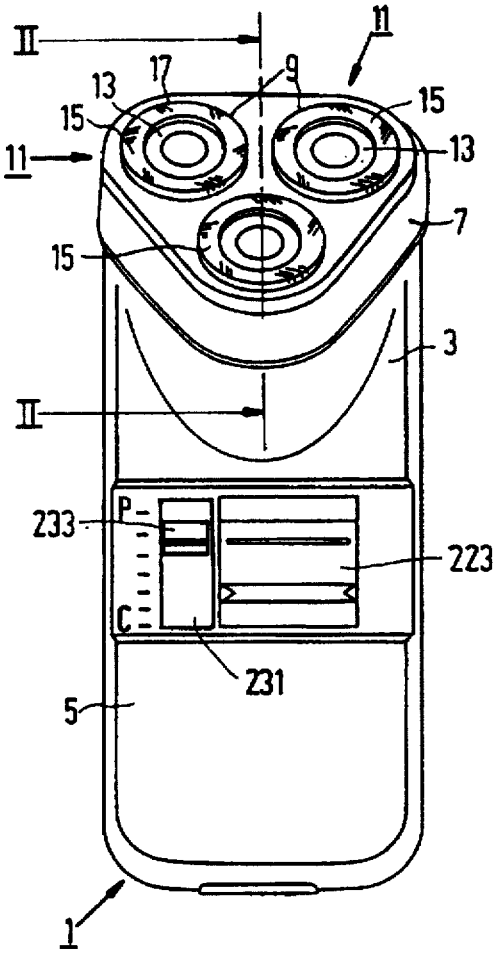
FIG. 1*a* is a front elevation of a first embodiment of a shaving apparatus according to the invention.
Figure 1B:
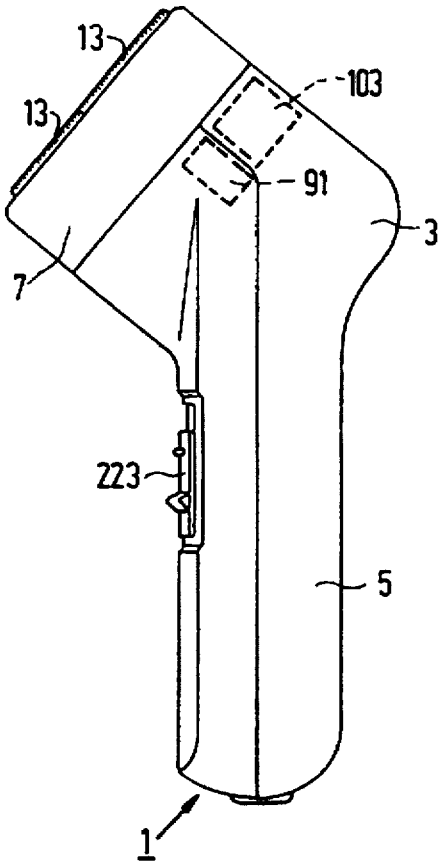
FIG. 1*b* is a side elevation of the shaving apparatus of FIG. 1*a*.
Figure 2:
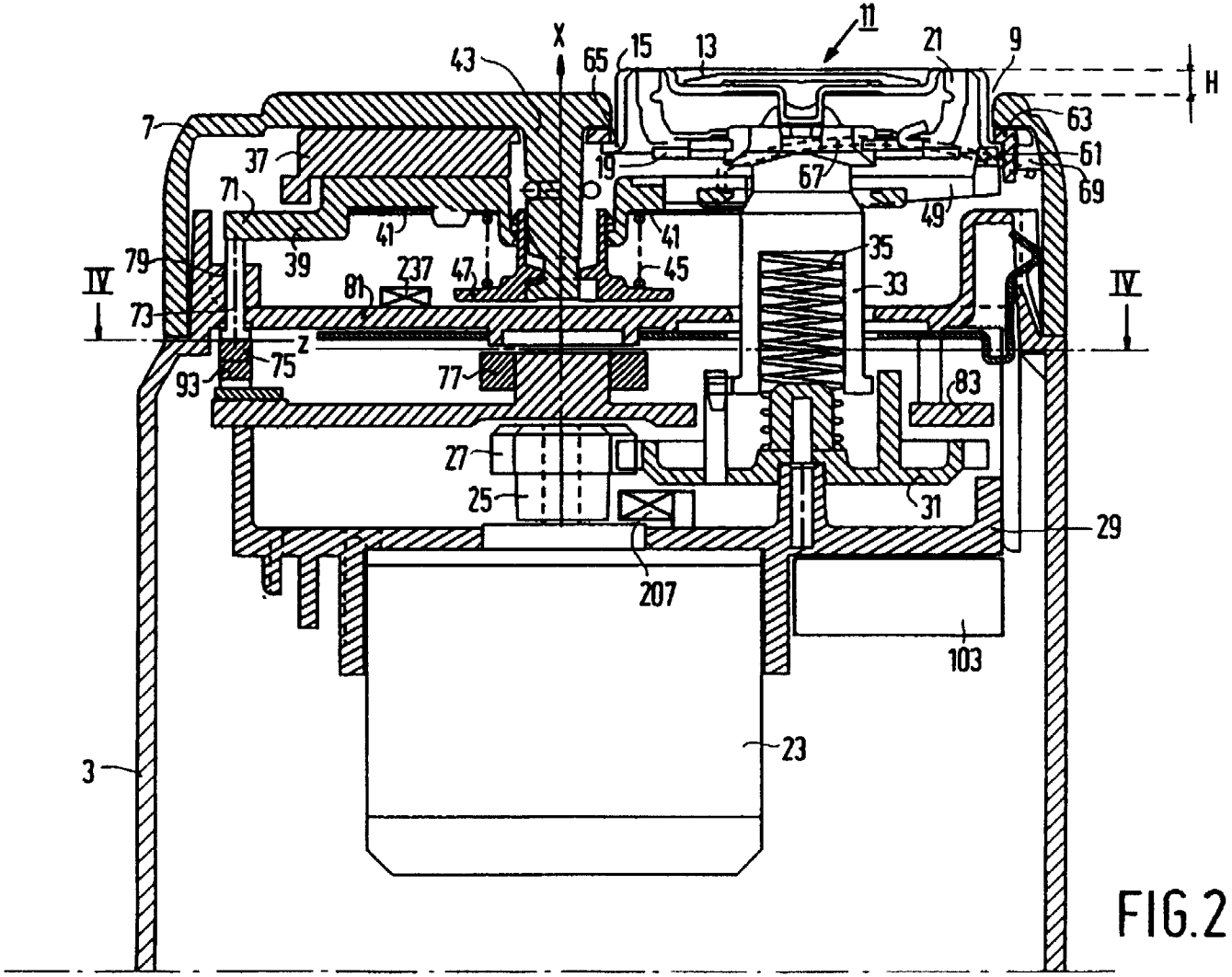
FIG. 2 is a cross-section taken on the line II—II in FIG. 1*a*.

A first embodiment of a shaving apparatus 1 according to the invention shown in FIGS. 1 to 4 comprises a housing 3 with a handle 5 for a user of the shaving apparatus 1. The housing 3 has a holder 7 in which three round openings 9 are provided in triangular arrangement, a cutting unit 11 being positioned in each opening 9. The cutting units 11 each comprise an external cutting member 13, which is provided with an annular rim 15 in which slotted hair trap openings 17 are provided. As is visible in FIG. 2, the cutting units 11 further comprise an internal cutting member 19 with a rim of cutters 21 which are present in the rim 15 of the external cutting member 13. The internal cutting members 19 are rotatable in the external cutting members 13 by means of an electric motor 23 arranged in the housing 3, comprising an output shaft 25 with a gear 27, and fastened to a motor frame 29. In the motor frame 29, furthermore, three gears 31 have their rotation bearings, which gears are in engagement with the gear 27 of the output shaft 25. The gears 31 are each coupled to a hollow drive shaft 33 for a respective internal cutting member 19, which drive shafts 33 are slidable relative to the gears 31 in a direction parallel to an axial direction X shown in FIG. 2. A pretensioned mechanical helical spring 35 is fastened between the gears 31 and the drive shafts 33, whereby the internal cutting members 19 are held in the external cutting members 13 under the influence of a pretensioning force of the helical springs 35. It is noted that FIG. 2 shows only one gear 31, one drive shaft 33, one internal cutting member 19, and one external cutting member 13 in cross-section.

As is visible in FIG. 2, a common closing plate 37, a common carrier 39, and a common blade spring 41 for the three external cutting members 13 are present in the holder 7. The closing plate 37, the carrier 39 and the blade spring 41 are separately depicted in FIGS. 3*a*, 3*b* and 3*c*. As FIG. 2 shows, the closing plate 37, the carrier 39, and the blade spring 41 are fastened around a central fastening pin 43 of the holder 7 under the influence of a pretenionsing force of a mechanical spring 45 which is tensioned between the blade spring 41 and a blocking stud 47 which can be screwed onto the fastening pin 43.

Figure 3A:
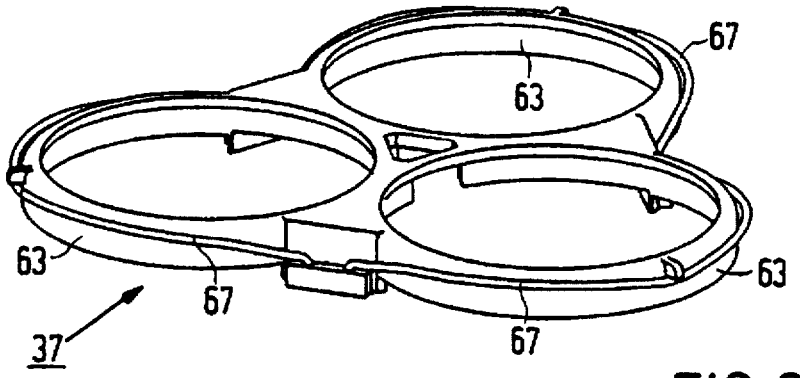
FIG. 3*a* shows a common closing plate of the shaving apparatus of FIG. 1*a*.
Figure 3B:
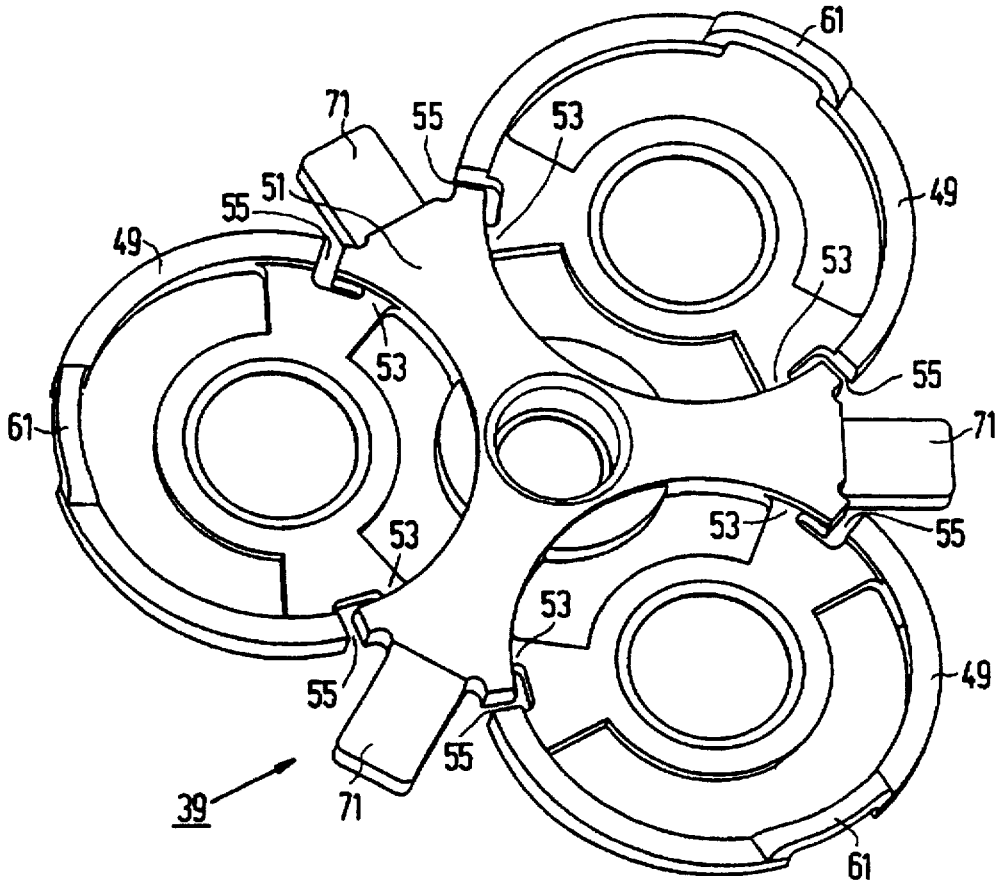
FIG. 3*b* shows a common carrier of the shaving apparatus of FIG. 1*a*.
Figure 3C:
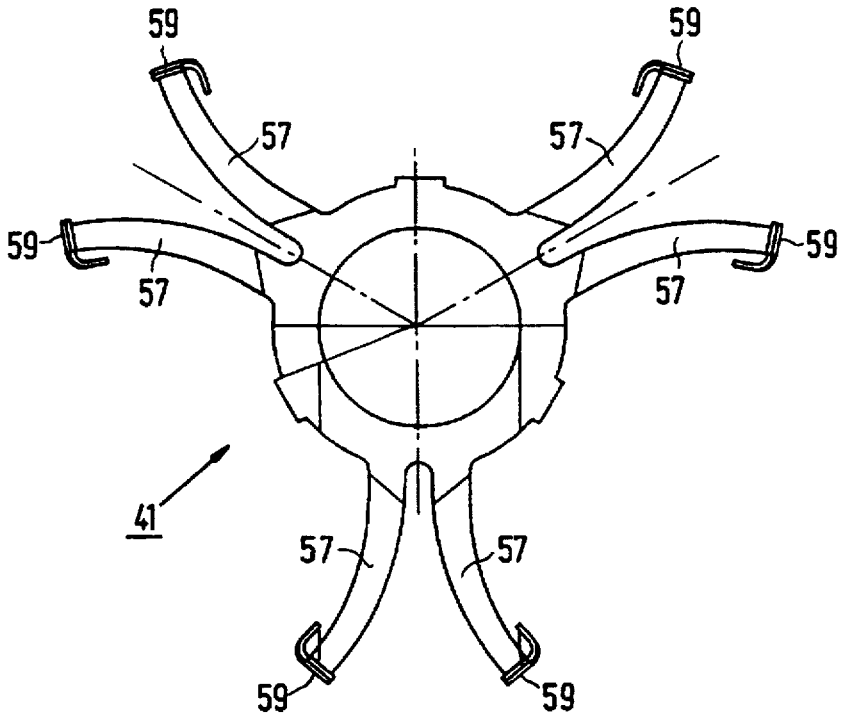
FIG. 3*c* shows a common blade spring of the shaving apparatus of FIG. 1*a*.

As FIG. 3*b* shows, the carrier 39 comprises three carrier rings 49 which are fastened to a star-shaped central portion 51 of the carrier 39 by means of elastic bridges 53, each of which has an opening 55. The use of the elastic bridges 53 and a favourable choice of the dimensions of the carrier rings 49 render the carrier rings 49 flexible relative to the central portion 51. Only one of the carrier rings 49 is visible in cross-section in FIG. 2. As FIG. 3*c* shows, the common blade spring 41 comprises three pairs of flexible strips 57 which each have a raised end 59. In the mounted state shown in FIG. 2, the raised ends 59 of the blade spring 41 are present in the openings 55 of the carrier 39, while the external cutting members 13 each rest on one pair of raised ends 59 and on a ridge 61 of one of the carrier rings 49 visible in FIG. 3*b*. In FIG. 2, the raised ends 59 are not visible, while only one ridge 61 is visible in cross-section. The external cutting members 13 are held in position relative to the carrier rings 49 by the common closing plate 37 shown in FIG. 3*a*, which is provided with three closing rings 63. Only one of the closing rings 63 is visible in cross-section in FIG. 2. As FIG. 2 shows, the external cutting members 13 have a flanged rim 65 with which the external cutting members 13 in the unloaded state bear on the closing rings 63 under the influence of a pretensioning force of the common blade spring 41. When the user applies the shaving apparatus 1 against his skin, the skin exerts a skin contact force on the external cutting members 13. The external cutting members 13 are individually displaceable relative to the holder 7 under the influence of said skin contact force, whereby the carrier tings 49 and the strips 57 of the blade spring 41 are bent relative to the central portion 51 of the carrier 39 over a distance which is dependent on the value of the skin contact force. The internal cutting members 19 follow the external cutting members 13 during this with the drive shafts 33 moving relative to the gears 31 parallel to the axial direction X.

Figure 3D:
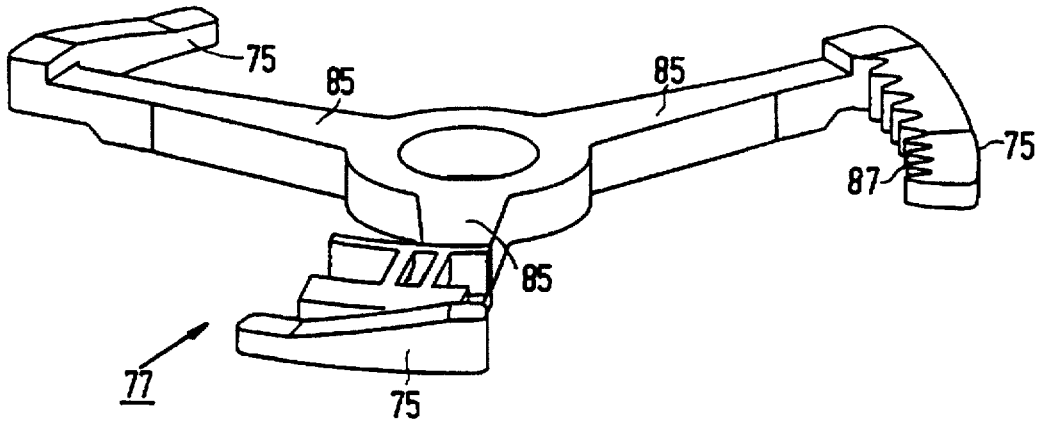
FIG. 3*d* shows an adjustment member of the shaving apparatus of FIG. 1*a*.
Figure 4:
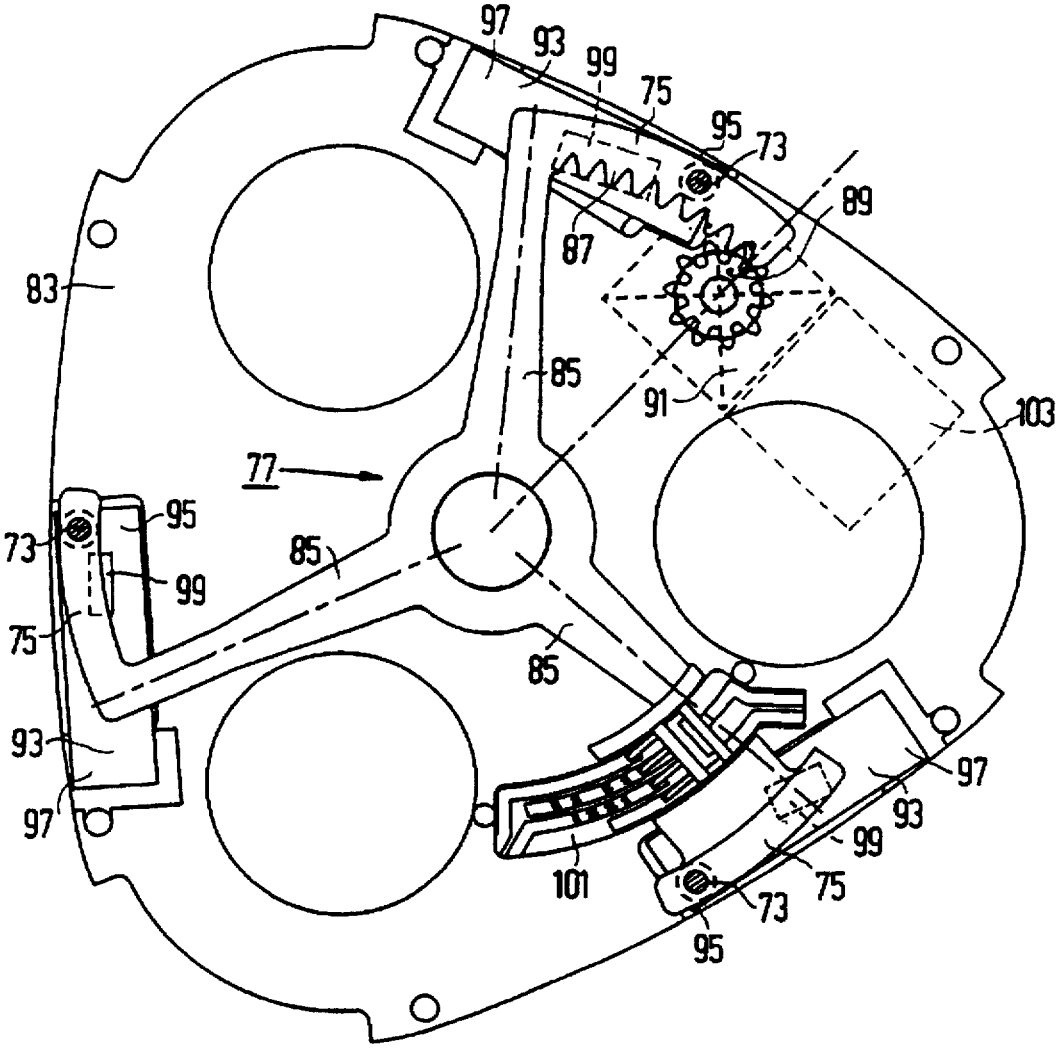
FIG. 4 is a cross-section taken on the line IV—IV in FIG. 2.

As FIG. 3*a* shows, a wire spring 67 is provided around each closing ring 63 of the closing plate 37. Only one of the wire springs 67 is visible in FIG. 2. As FIG. 2 shows, each wire spring 67 in the mounted state rests on a protrusion 69 provided in the holder 7, so that the wire springs 67 in the mounted state exert a pretensioning force on the closing plate 37. The closing plate 37 rests on the carrier 39 under the influence of the pretensioning force of the wire springs 67. As FIG. 3*b* further shows, the carrier 39 is provided with three support plates 71. Under the influence of the pretensioning force of the wire springs 67, the carrier 39 bears with the three support plates 71 via three pins 73 on three cams 75 which belong to an adjustment member 77 shown in FIG. 3*d*. It is noted that FIG. 2 shows only one of the support plates 71, one of the pins 73 and one of the cams 75 in cross-section. The pins 73 are guided so as to be displaceable parallel to the axial direction X in a channel 79 which is provided in a first intermediate plate 81 belonging to the housing 3, while the adjustment member 77 is journalled in a second intermediate plate 83 belonging to the housing 3 and extending parallel to the first intermediate plate 81. As FIG. 3*d* shows, the adjustment member 77 has three arms 85, the cams 75 being arranged at the ends of the arms 85. It is noted that the arms 85 are not visible in FIG. 2. One of the cams 75 is provided with a toothed rim 87 on an inside, which toothed rim is in engagement with a pinion 89 provided on an output shaft of an electrical actuator 91 fastened to the second intermediate plate 83, as is shown in FIG. 4. The cams 75 each have an oblique profile on an upper side. When the adjustment member 77 is rotated relative to the holder 7 by means of the actuator 91, the carrier 39 and closing plate 37 resting on the cams 75 via the pins 73 are displaced parallel to the axial direction X relative to the holder 7 under elastic deformation of the wire springs 67, so that a height H shown in FIG. 2 over which the external cutting members 13 project from the holder 7 in the unloaded state changes.

As FIGS. 2 and 4 show, a strip-shaped elastically deformable bridge 93 is present below each cam 75 of the adjustment member 77. Only one of the bridges 93 is shown in cross-section in FIG. 2. As FIG. 4 shows, the cams 75 rest on first ends 95 of the bridges 93, the ends 95 being arranged below the pins 73. Second ends 97 of the bridges 93 are fastened to the second intermediate plate 83. The bridges 93 have a mechanical stiffness parallel to the axial direction X which is comparatively great in relation to a mechanical stiffness of the arms 85 of the adjustment member 77 in said direction. A strain gauge sensor 99 which is known per se and generally used, is provided on each bridge 93. A skin contact force exerted on the external cutting members 93 is transmitted through the common carrier 39, the pins 73, and the cams 75 to the bridges 93, which are elastically deformed under the influence of the skin contact force. Since the mechanical stiffness of the bridges 93 parallel to the X-direction is comparatively great in relation to the mechanical stiffness of the arms 85, the deformation of the bridges 93 is determined substantially solely by the value of the skin contact force, so that the skin contact force can be measured by means of said strain gauge sensors 99.

As FIG. 4 further shows, a position sensor 101 is present near one of the cams 75 such as, for example, a digital position detector which is known per se and generally used, whereby an angle of rotation of the adjustment member 77 relative to the holder 7 can be measured. Since the cams 75 have a defined shape, the height H can be derived from a measured angle of rotation of the adjustment member 77, H being the height over which the external cutting members 13 project from the holder 7 in the unloaded state.

The shaving apparatus 1 is provided with an electrical control unit 103 with which the actuator 91, i.e. the height H over which the external cutting members 13 project from the holder 7 in the unloaded state, and the speed of the motor 23 can be controlled in a manner yet to be described further below. The shaving performance of the shaving apparatus 1, i.e. the speed of the shaving process and the achievable skin smoothness, and the shaving comfort experienced by the user during the shaving, process, i.e. the skin irritation level, depend on said height H and the speed of the motor 23. When the height H is comparatively small, the deformation of the skin around the external cutting members 13 is comparatively small. In this condition, the skin penetrates the hair trap openings 17 of the external cutting members 13 to a comparatively small depth, so that the shaving comfort is comparatively great, but the shaving performance comparatively low. If said height H is comparatively great, the skin deformation around the external cutting members 13 is comparatively great. In this condition, the skin penetrates the hair trap openings 17 over a comparatively great depth, so that the shaving performance is comparatively high but the experienced skin comfort comparatively small. Furthermore, the skin irritation level is greater at a comparatively high speed of the motor 23 than at a comparatively low speed of the motor 23. The shaving performance and shaving comfort further depend on a number of conditions which change in the course of a shaving operation or a number of shaving operations such as, for example, the hair supply, i.e. the number of hairs per unit skin surface to be cut, or the skin contact force referred to above. Since the height H and the speed of the shaving apparatus 1 can be controlled by the control unit 103, the height H and the speed, i.e. the shaving performance and shaving comfort, can be made variable during the shaving operation when said conditions change during the shaving operation. In this manner, a particularly favourable balance between the achieved shaving performance and the experienced shaving comfort is obtained throughout the shaving operation.

A second embodiment of a shaving apparatus 105 according to the invention shown in FIGS. 5 to 9 comprises a housing 107 which is also provided with a handle 109 for a user of the shaving apparatus 105. The housing 107 has a holder 111 which is shown in detail in FIG. *7a* and in which three openings 113 are provided in triangular arrangement. As FIG. *7a* shows, a frame 115 is fastened in each opening 113, which frame is pivotable relative to the holder 111 about a pivot axis 117. The frames 115 adjoin one another two-by-two by their sides 119 which are arranged relative to one another in a star shape. The sides 119 are in engagement with one another, so that the frames 115 can pivot jointly only about the pivot axes 117.

Figure 5:
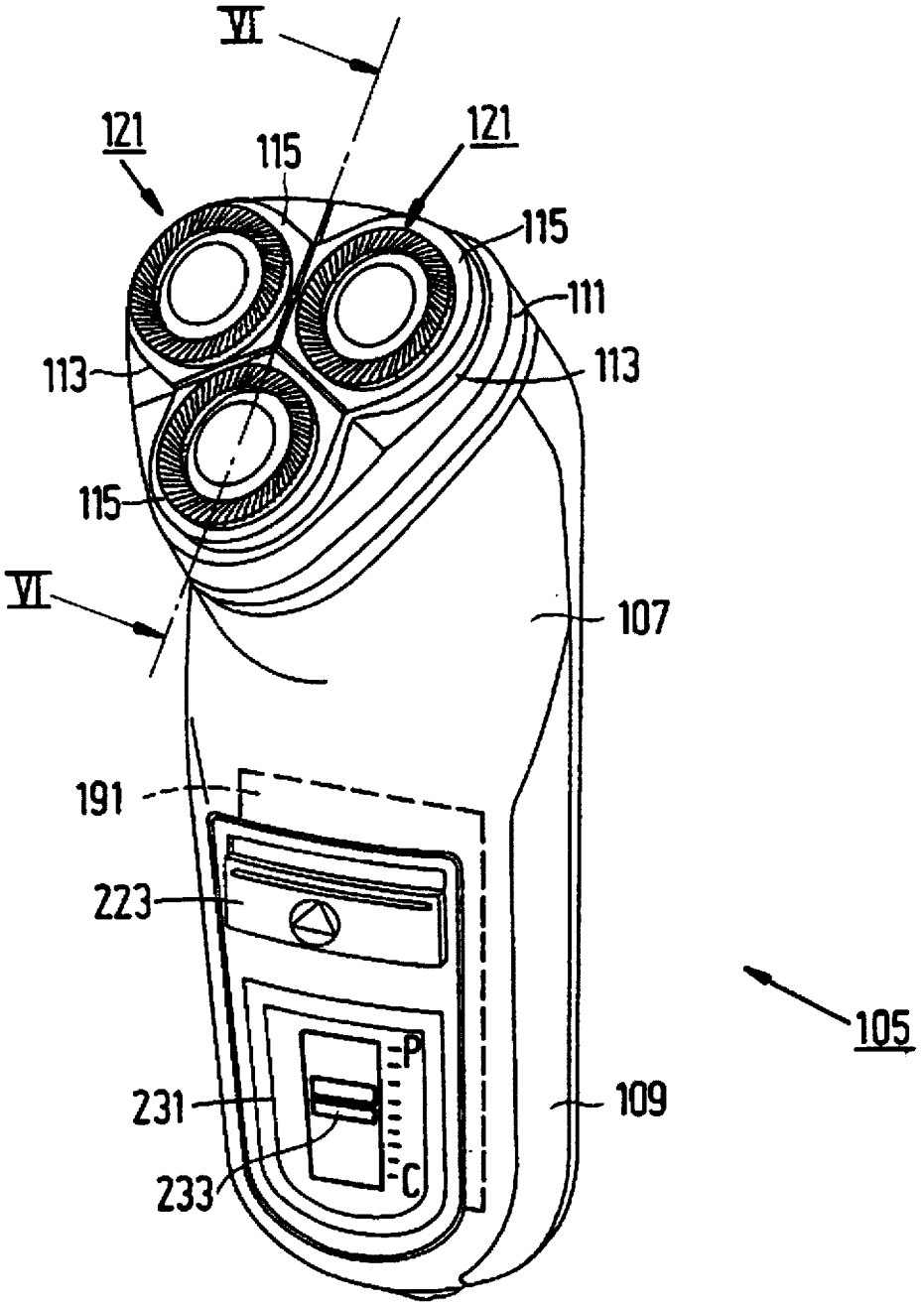
FIG. 5 shows a second embodiment of a shaving apparatus according to the invention.
Figure 6:
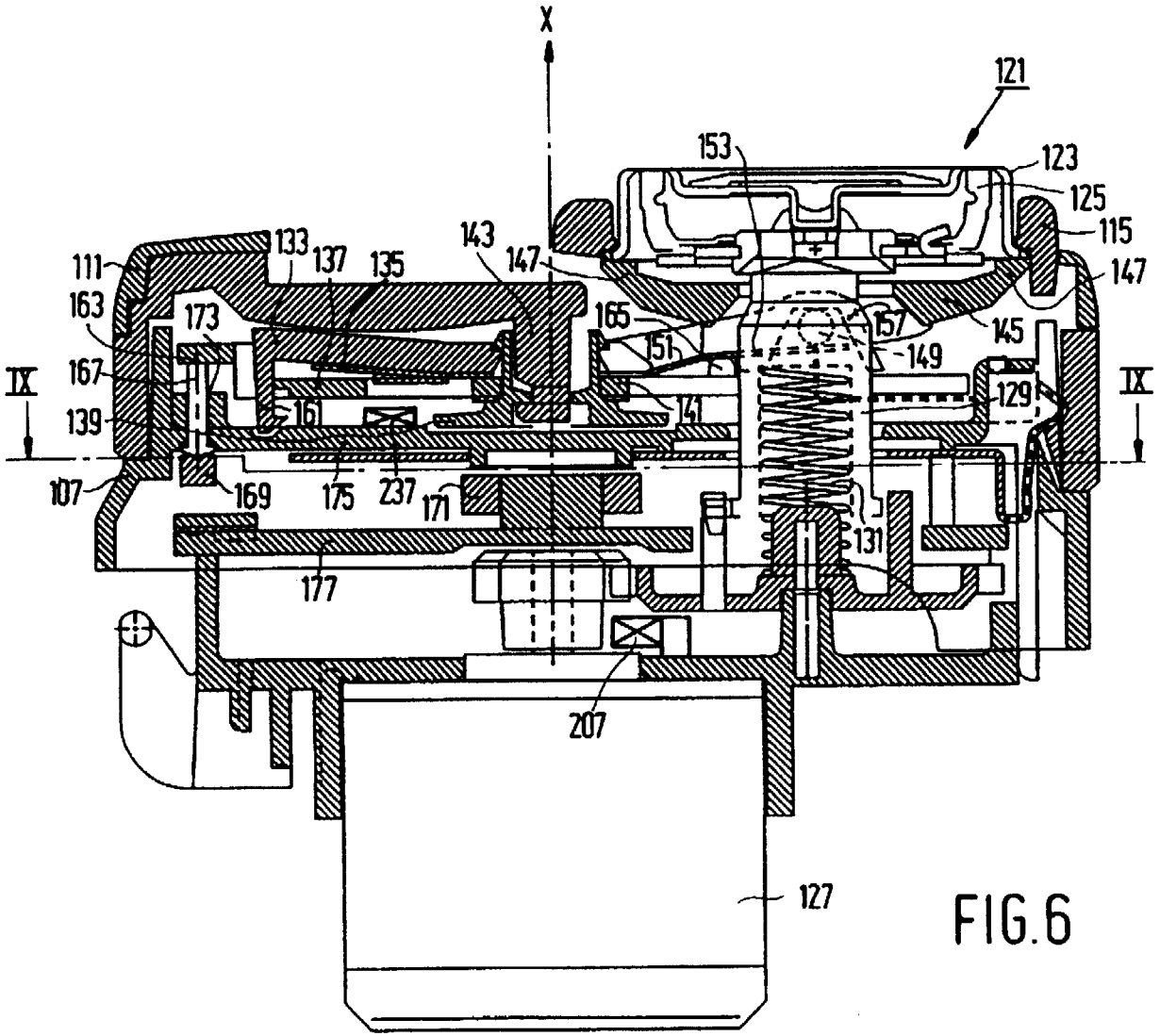
FIG. 6 is a cross-section taken on the line VI—VI in FIG. 5.
Figure 7A:
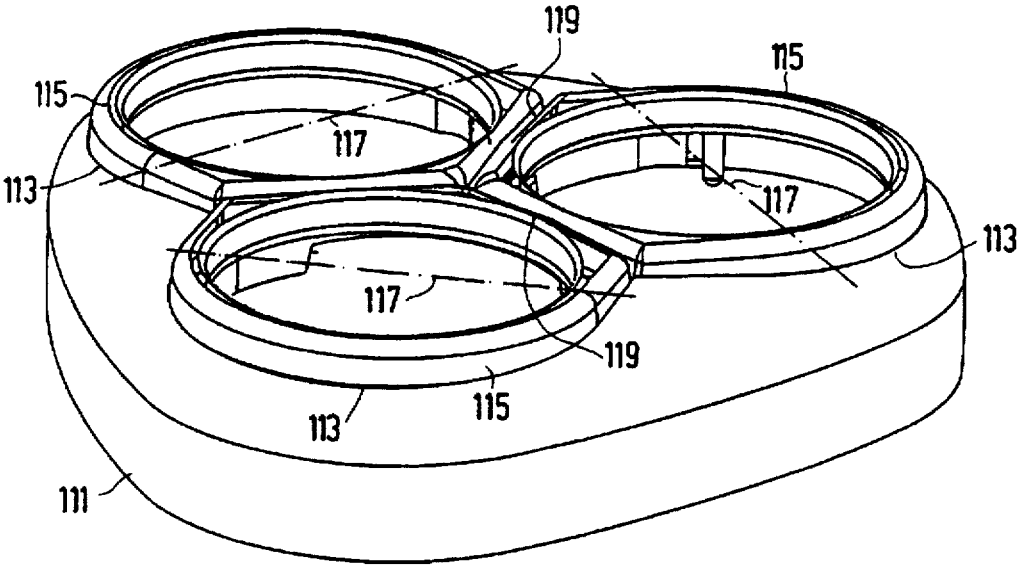
FIG. 7*a* shows a holder of the shaving apparatus of FIG. 5.
Figure 7B:
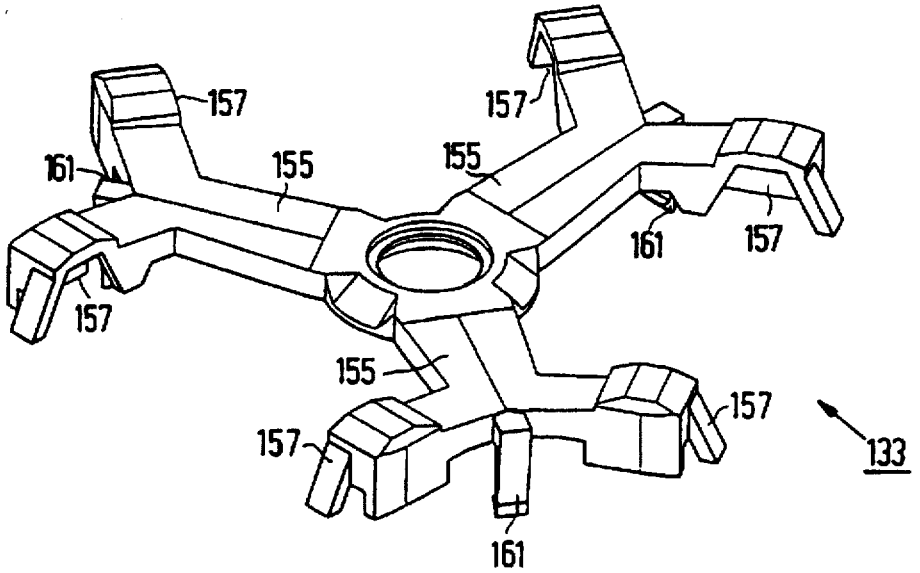
FIG. 7*b* shows a common closing plate of the shaving apparatus of FIG. 5.
Figure 7C:
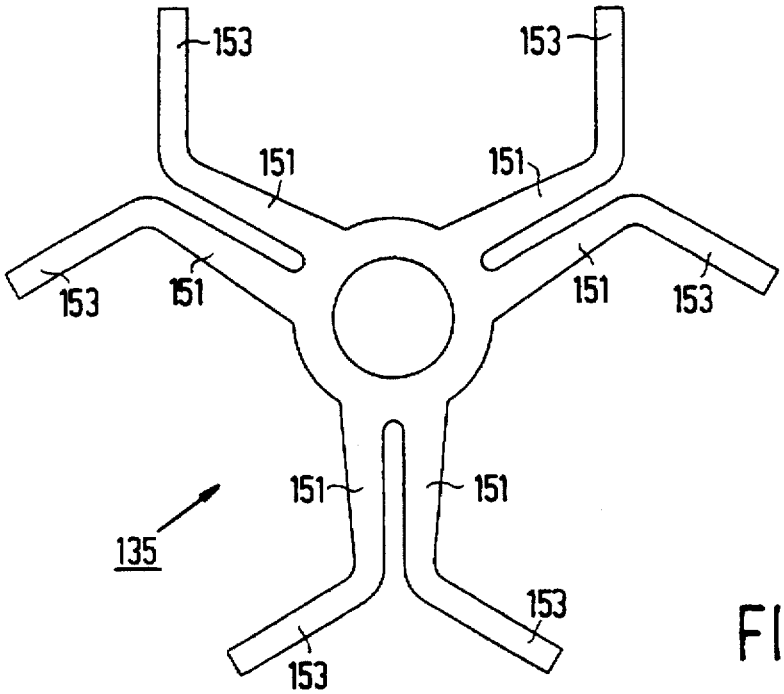
FIG. 7*c* shows a common blade spring of the shaving apparatus of FIG. 5.
Figure 7D:
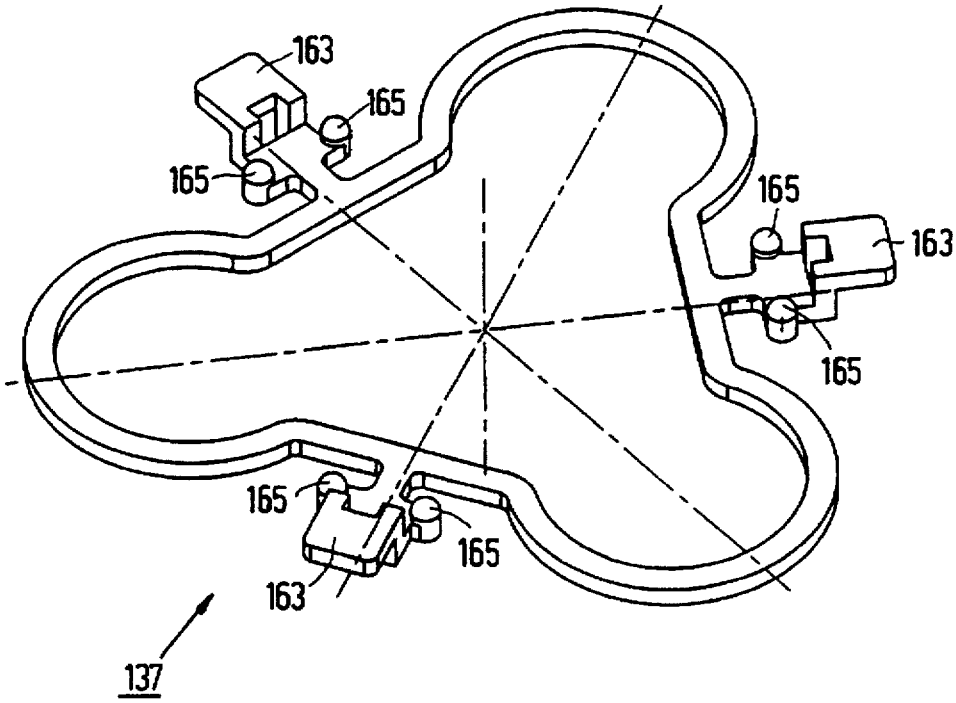
FIG. 7*d* shows a common carrier of the shaving apparatus of FIG. 5.
Figure 7E:
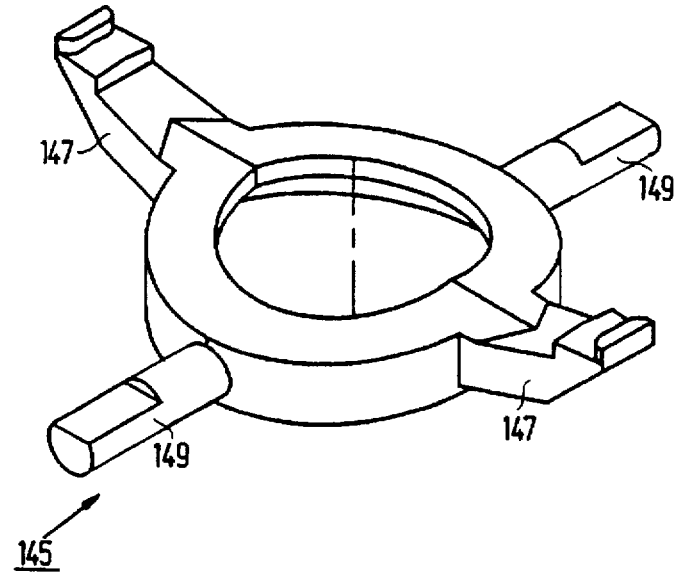
FIG. 7*e* shows a support ring of the shaving apparatus of FIG. 5.

As is visible in FIGS. 5 and 6, a cutting unit 121 is arranged in each frame 115 with an external cutting member 123 and an internal cutting member 125 provided therein. The external cutting member 123 and internal cutting member 125 correspond to the external and internal cutting members 13 and 19 of the shaving apparatus 1 described above. The internal cutting members 125 can be driven into rotation by means of an electric motor 127 via a transmission which corresponds to that of the shaving apparatus 1, while the internal cutting members 125 are each coupled to a drive shaft 129 which is slidable parallel to an axial X-direction against a pretensioning force of a mechanical spring 131. Only one frame 115, one external cutting member 123, one internal cutting member 125 and one drive shaft 129 are visible in cross-section in FIG. 6.

Figure 8:
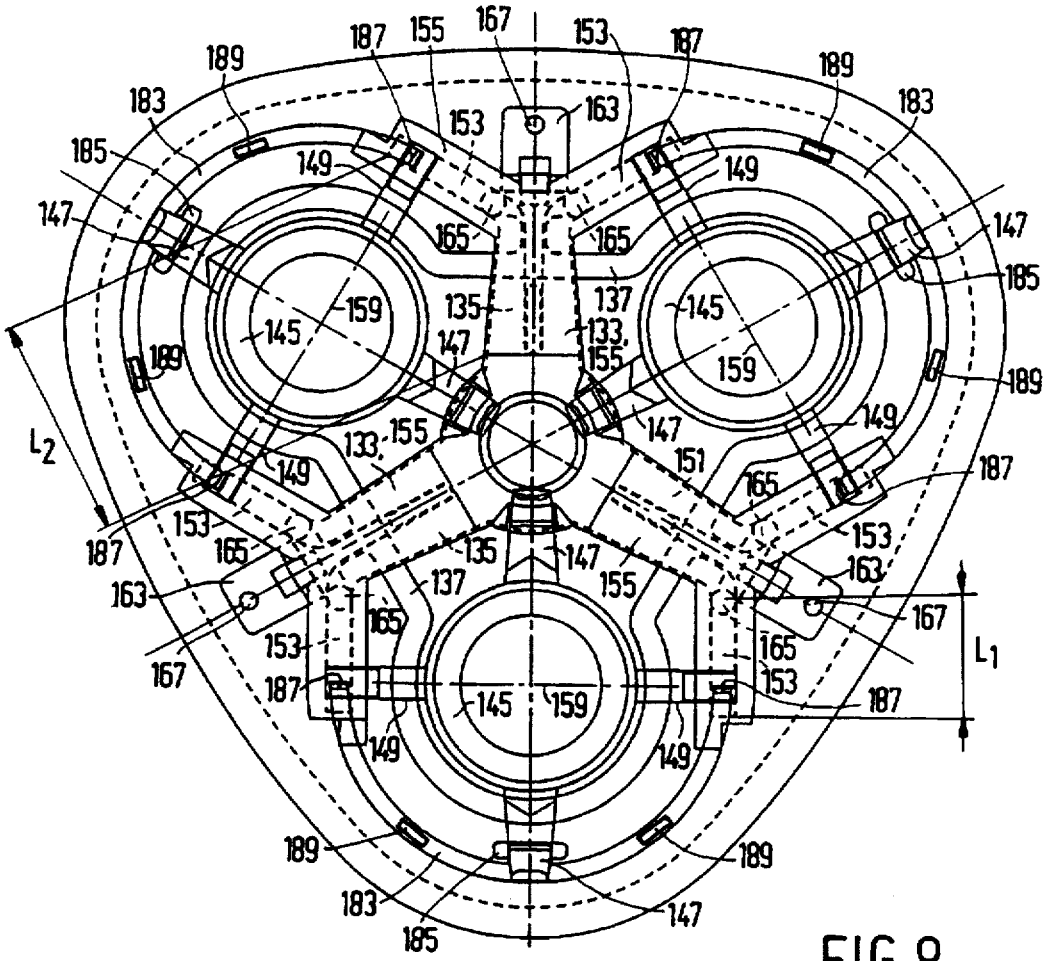
FIG. 8 is a plan view of the closing plate of FIG. 7*b*, the blade spring of FIG. 7*c*, the carrier of FIG. 7*d*, and the support rings of FIG. 7*e* in the mounted state.

As is visible in FIGS. 6 and 8, the following are present in the holder 111: a common closing plate 133, a common blade spring 135, and a common carrier 137 for the three external cutting members 123. The closing plate 133, the blade spring 135, and the carrier 137 are individually shown in FIGS. *7b*, *7c* and *7d*. As FIG. 6 shows, the closing plate 133 and the blade spring 135 are fastened around a central fastening pin 143 of the holder 111 by means of a blocking stud 139 and a closing ring 141. As FIG. 6 further shows, each external cutting member 123 is closed up between one of the frames 115 and a support ring 145 shown in FIG. *7e*. Only one support ring 145 is visible in cross-section in FIG. 6. As FIGS. 6 and *7e* show, the support rings 145 each comprise two support arms 147 on which the relevant external cutting member 123 rests, and two journals 149 which are clamped in between the closing plate 133 and the blade spring 135 under the influence of a pretensioning force of the blade spring 135 in a manner yet to be described below. FIG. 6 shows only one of the journals 149 of the support ring 145 represented. As FIG. *7c* shows, the blade spring 135 has three pairs of flexible strips 151 which each have an end 153 bent in the plane of the blade spring 135. As FIG. *7b* shows, the closing plate 133 has three forked arms 155 each provided with two tapering seats 157. In a mounted state shown in FIGS. 6 and 8, the journals 149 of each support ring 145 are present in two mutually opposed seats 157 of two different arms 155 of the closing plate 133. The journals 149 are supported then by two mutually opposed ends 153 of two strips 151 of the blade spring 135 belonging to two different pairs. In FIG. 6, only one journal 149, one seat 157, and one strip 151 with bent end 153 are visible.

The external cutting members 123 and the support rings 145 are individually displaceable relative to the holder 111 and the frames 115 against the pretensioning force of the blade spring 135 under the influence of a skin contact force exerted on the external cutting members 123. Furthermore, the external cutting members 123 and the support rings 145 are pivotable relative to the holder 111 about a pivot axis 159 shown in FIG. 8, which extends through the journals 149 and runs parallel to the pivot axis 117 of the relevant frame 115, under the influence of a skin contact force.

As FIG. *7b* further shows, the closing plate 133 comprises three flexible hooks 161. Only one hook 161 is visible in FIG. 6. Said common carrier 137 is connected to the closing plate 133 by means of the hooks 161, the carrier 137 being displaceable between the blade spring 135 and the ends of the hooks 161. As FIG. *7d* shows, the common carrier 137 comprises three support plates 163 and three pairs of support elements 165 which are each provided near one of the support plates 163. Via three pins 167, the three support plates 163 bear on three cams 169 which belong to an adjustment member 171 visible in FIG. 9 and corresponding to the adjustment member 77 shown in FIG. *3d*. Only one of the support plates 163, one of the support elements 165, one of the pins 167, and one of the cams 169 are visible in FIG. 6. The pins 167 are each guided so as to be displaceable parallel to the axial direction X in a channel 173 provided in a first intermediate plate 175 belonging to the housing 107, while the adjustment member 171 is journalled in a second intermediate plate 177 belonging to the housing 107 and extending parallel to the first intermediate plate 175.

Figure 9:
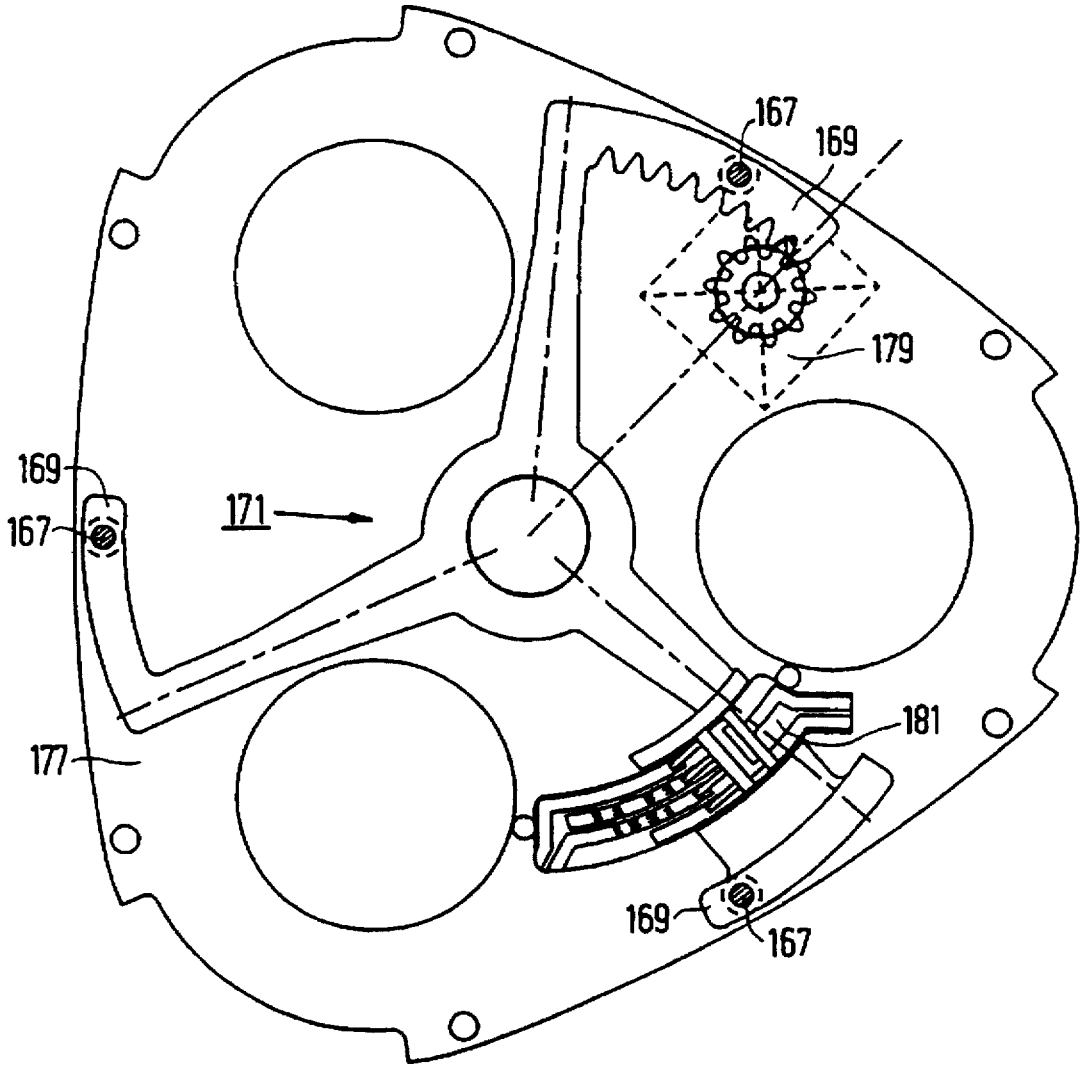
FIG. 9 is a cross-section taken on the line IX—IX in FIG. 6.

In an uppermost position of the carrier 137 and the support elements 165 shown in FIG. 6, the flexible strips 151 of the blade spring 135 are each supported by one of the support elements 165. Only one support element 165 is visible in FIG. 6. As can be seen in FIG. 8, the strips 151 are supported near a central portion where the strips 151 are bent. Since the support rings 145 and the external cutting members 123 are supported by the bent ends 153 of the strips 151, the pretensioning force of the strips 151 in the uppermost position of the carrier 137 is determined by an effective length $L_1$ of the strips 151 shown in FIG. 8. In a bottom position of the carrier 137 and the support elements 165, the flexible strips 151 are not supported by the support elements 165 both in a condition in which the external cutting members 123 are unloaded and in a condition in which the external cutting members 123 are substantially sunken into the frames 115 under the influence of a comparatively great skin contact force. The pretensioning force of the strips 151 in the bottom position of the carrier 137, accordingly, is determined by an effective length $L_2$ shown in FIG. 8 which is greater than the effective length $L_1$ mentioned above. When the carrier 137 and the support elements 165 are in an intermediate position between the uppermost and bottom position, the effective length of the strips 151 is equal to $L_2$ when the external cutting members 123 are unloaded or are subjected to a comparatively small skin contact force, and the effective length is equal to $L_1$ when the external cutting members 123 are subjected to a comparatively great skin contact force. With the carrier 137 in the uppermost position, the strips 151 have a comparatively great mechanical stiffness as a result of the comparatively small effective length $L_2$ of the strips 151, so that the pretensioning force of the strips 151 is also comparatively great. With the carrier 137 in the bottom position, the strips 151 have a comparatively small mechanical stiffness as a result of the comparatively great effective length $L_2$, so that the pretensioning force of the strips 151 is comparatively small. In the intermediate position of the carrier 137, the pretensioning force of the strips 151 is comparatively small in an unloaded state of the external cutting members 123 and with comparatively small skin contact forces, whereas the pretensioning force of the strips 151 is comparatively great for comparatively great skin contact forces. As FIG. 9 shows, the adjustment member 171 is rotatable relative to the holder 111 in a manner similar to that of the adjustment member 77 of the shaving apparatus 1 by means of an electrical actuator 179 fastened to the second intermediate plate 177. The value of the pretensioning force of the blade spring 135 is thus adjustable through rotation of the adjustment member 171 by means of the actuator 179.

As is visible in FIG. 9, a position sensor 181 corresponding to the position sensor 101 of the shaving apparatus 1 is present near one of the cams 169 of the adjustment member 171. A rotational angle of the adjustment member 171 relative to the holder 111 is measurable by means of the position sensor 181. Since the cams 169 have a defined shape, the support elements 165 of the carrier 137 have a defined position in a direction parallel to the axial direction X as a function of said rotational angle of the adjustment member 171, so that the mechanical stiffness of the strips 151 is indirectly measurable by means of the position sensor 181. FIG. 8 further shows that three strip-shaped springs 183 are present in the holder 111. The strip-shaped springs 183 are each fastened to the housing 107 by means of a hook 185 and are each provided with two raised ends 187 by means of which the springs 183 each rest under a pretension against the bent ends 153 of the strips 151 of the blade spring 135. Two strain gauge sensors 189, which are known per se and generally used, are provided on each strip-shaped spring 183. When the external curing members 123 are displaced relative to the holder 111 under the influence of a skin contact force, the strip-shaped springs 183 resting against the strips 151 are deformed. Since the deformation of the strip-shaped springs 183 is determined by the position of the external cutting members 123, the position of the external cutting members 123 can be measured by means of the strain gauge sensors 189. The pretensioning force of the strips 151, which follows from the mechanical stiffness of the strips 151 and the position of the external cutting members 123, can be derived in a manner to be described further below from the mechanical stiffness value of the strips 151 measured by means of the position sensor 181 and the position of the external cutting members 123 measured by means of the strain gauge sensors 189.

As FIG. 5 further shows, the shaving apparatus 105 is provided with an electrical control unit 191 with which the actuator 179, i.e. the mechanical stiffness of the strips 151 and the pretensioning force of the blade spring 135, as well as the speed of the motor 127, can be controlled in a manner to be described further below. The shaving performance of the shaving apparatus 105 and the shaving comfort experienced by the user of the shaving apparatus 105 during a shaving operation depend on the pretensioning force of the blade spring 135 and the speed of the motor 127. It has been explained above with reference to the shaving apparatus 1 how the shaving performance and the shaving comfort depend on the speed of the motor 23, 127. When the pretensioning force of the blade spring 135 is comparatively small, the external cutting members 123 are displaced over a comparatively great distance relative to the holder 111 as a result of a skin contact force exerted on the cutting members 123, so that the external cutting members 123 will lie comparatively deeply recessed in the holder 111 under the influence of the skin contact force and the deformation of the skin around the external cutting members 123 will be comparatively small. Under these circumstances, the skin will penetrate the hair trap openings of the external cutting members 123 over a small distance only, so that the shaving comfort is comparatively high but the shaving performance comparatively low. When the pretensioning force of the blade spring 135 is comparatively great, the external cutting members 123 are displaced relative to the holder 111 over a comparatively small distance as a result of the skin contact force, so that in spite of the skin contact force the external cutting members 123 project comparatively far from the holder 111, and the skin deformation around the external cutting members 123 is comparatively great. Under these circumstances, the skin penetrates comparatively deeply into the hair trap openings of the external cutting members 123, so that the shaving performance is comparatively high but the experienced shaving comfort is comparatively low. The shaving performance and shaving comfort of the shaving apparatus 105 also depend on other conditions, as in the case of the shaving apparatus 1, such as the value of the skin contact force and the time which has elapsed during a shaving operation. Since the pretensioning force of the blade spring 135 and the speed of the motor 127 can be controlled by the control unit 191, said pretensioning force and speed, i.e. the shaving performance and shaving comfort, are adjustable during the shaving operation when said conditions change during the shaving operation. Thus a particularly favourable balance is achieved between the shaving performance of the shaving apparatus 105 and the shaving comfort experienced by the user throughout the shaving operation.

It is apparent from the preceding descriptions of the first embodiment of the shaving apparatus 1 and the second embodiment of the shaving apparatus 105 that the shaving performance and the shaving comfort are qualitatively equally influenced by an increase or decrease in the height H of the external cutting members 13 above the holder 7 of the shaving apparatus 1 and by an increase or decrease in the pretensioning force of the blade spring 135 of the shaving apparatus 105. The control unit 103 of the shaving apparatus 1 and the control unit 191 of the shaving apparatus 105, accordingly, are essentially the same. The block diagram shown in FIG. 10 therefore relates both to the control unit 103 of the shaving apparatus 1 and to the control unit 191 of the shaving apparatus 105.

Figure 10:
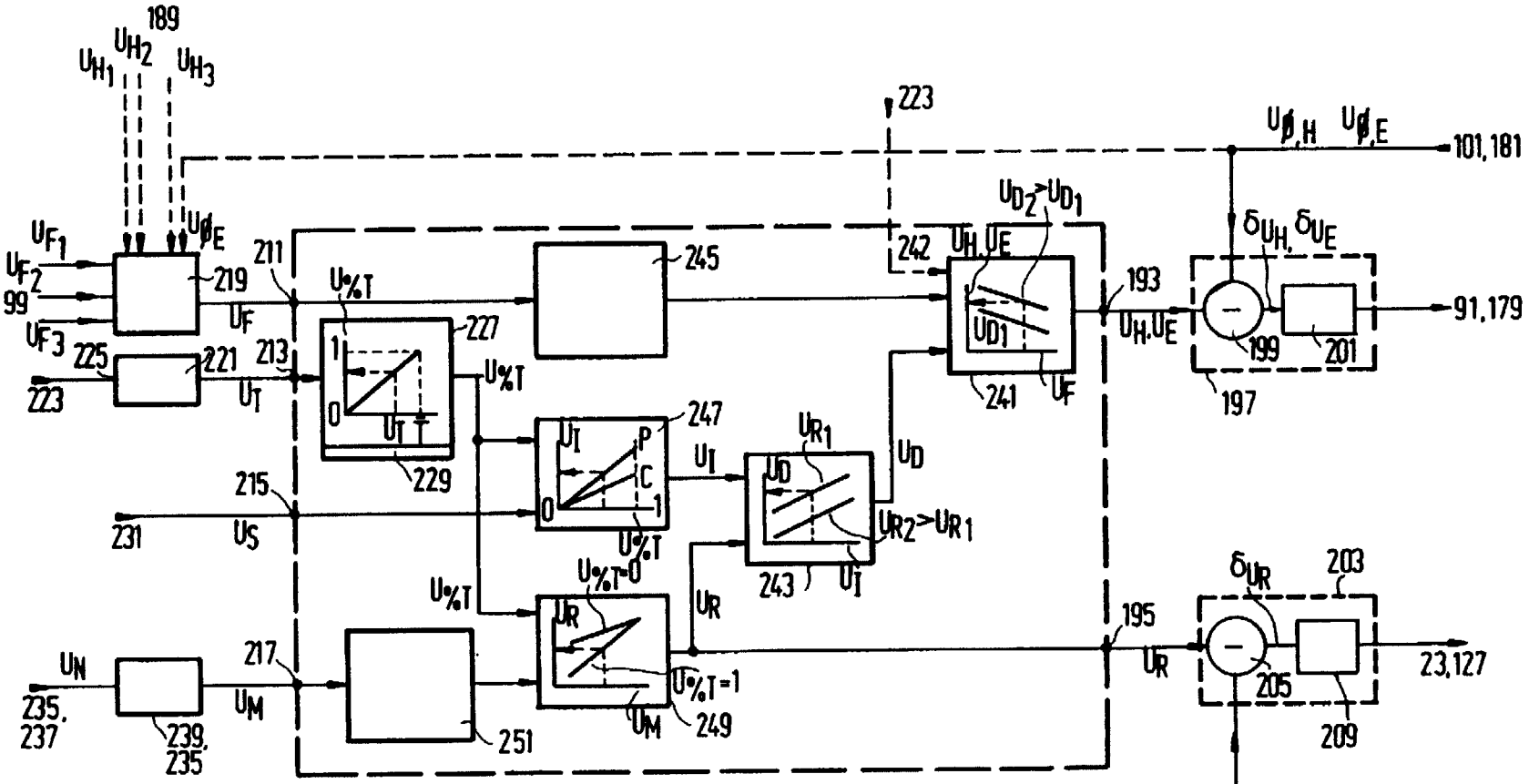
FIG. 10 is a block diagram of a control unit of the shaving apparatus of FIG. 1*a* or FIG. 5, FIGS. 11*a* to 11*d* show membership functions of input signals and output signals based on fuzzy logic of a first, a second, a third, and a fourth sub-processor, respectively, of the control unit of FIG. 10, and FIGS. 12*a* to 12*d* contain Tables in which a class of the output signals assigned in accordance with a logic rule is represented as a function of the input signals of the sub-processors of the control unit of FIG. 10.

As FIG. 10 shows, the control unit 103, 191 has a first electrical output 193 for supplying a first electrical output signal $u_H$ or $u_E$, corresponding to a desired height H of the external cutting members 13 of the shaving apparatus 1 or to a pretensioning force of the blade spring 135 of the shaving apparatus 105 as determined by the relevant control unit 103, 191. The control unit 103, 191 further comprises a second electrical output 195 for supplying a second electrical output signal $u_R$ which corresponds to a desired speed of the motor 23, 127 determined by the control unit 103, 191. The first output signal $u_H$, $u_E$ is offered to an electrical supply unit 197 of the actuator 91, 179. As FIG. 10 shows, the supply unit 197 comprises a comparator 199 which compares the first output signal $u_H$, $u_E$ with an output signal $u_{100\ H}$, $u_{\phi,E}$, supplied by the position sensor 101, 181 and corresponding to a measured height H of the external cutting members 13 and to a measured mechanical stiffness of the blade spring 135, respectively. The supply unit 197 further comprises a controller 201, which is known per se and in general use, which drives the actuator 91, 179 such that a differential signal $\delta u_H = u_H - u_{100\ H}$ or $\delta u_E = u_E - u_{100\ E}$ supplied by the comparator 199 becomes equal to zero, so that the measured height H of the external cutting members 13 or the measured mechanical stiffness of the blade spring 135 are equal to the desired height H and the desired mechanical stiffness, respectively. The second output signal $u_R$ is applied to an electrical supply unit 203 of the motor 23, 127. The supply unit 203 also comprises a comparator 205 which compares the second output signal $u_R$ with an output signal $u_{RR}$ supplied by a motor speed sensor which is known per se and generally used, which is depicted in FIGS. 2 and 6, and which measures a speed of the output shaft 25 of the motor 23, 127. The supply unit 203 further comprises a controller 209, which is known per se and generally used, which controls the motor 23, 127 such that a differential signal $\delta u_R = u_R - u_{RR}$ supplied by the comparator 205 becomes equal to zero, i.e. the measured speed of the motor 23, 127 is then equal to the desired speed.

As FIG. 10 further shows, the control unit 103, 191 has a first electrical input 211 for receiving a first electrical input signal $u_F$ which corresponds to a measured skin contact force exerted on the external cutting members 13, 123, a second electrical input 213 for receiving a second electrical input signal $u_T$ which corresponds to a measured time which has elapsed during a shaving operation, a third electrical input 215 for receiving a third electrical input signal $u_S$ which corresponds to a desired ratio between shaving performance and shaving comfort set by the user, and a fourth electrical input 217 for receiving a fourth electrical input signal $u_M$ which corresponds to a measured cutting frequency, i.e. a number of hairs cut by the cutting units 11, 121 per unit time. The control unit 103, 191 controls the actuator 91, 179 and the speed of the motor 23, 127 in a manner yet to be described below in dependence on the four input signals $u_F$, $u_T$, $u_S$ and $u_M$, so that the shaving performance and shaving comfort are adapted to the wishes and properties of the user and to the manner in which the user uses the shaving apparatus 1, 105. An optimum balance between shaving performance and shaving comfort is thus obtained for the user.

The first electrical input signal $u_F$ is supplied by a processor 219. In the first embodiment of the shaving apparatus 1, the input signal $u_F$ corresponds to an average of three signals $u_{F1}$, $u_{F2}$ and $U_{F3}$, each corresponding to a skin contact force measured by one of the three strain gauge sensors 99, which average is calculated by the processor 219. In the second embodiment of the shaving apparatus 105, the output signal $u_F$ corresponds to a measured average skin contact force calculated by the processor 219 as a function of the output signal $u_{\phi,E}$ supplied by the position sensor 181 and corresponding to the measured mechanical stiffness of the blade spring 135, and of three signals $u_{H1}$, $u_{H2}$ and $u_{H3}$, each corresponding to a position of the external cutting members 123 as measured by one of the three pairs of strain gauge sensors 189. The output signal $u_{\phi E}$ of the position sensor 181 thus forms an input signal for the comparator 199, with which the desired and measured mechanical stillnesses of the blade spring 135 are compared, as well as an input signal for the processor 219 with which the skin contact force is calculated. The number of sensors required is limited thereby. In FIG. 10, the input signals $U_{\phi,E}$, $u_{H1}$, $u_{H2}$ and $u_{H3}$ of the processor 219 in the second embodiment of the shaving apparatus 105 have been indicated by means of broken lines.

The second electrical input signal $u_T$ is supplied by a timer 221 which measures the time which has elapsed from a moment at which the shaving apparatus 1, 105 was switched on by the user by means of a switching button 223 visible in FIGS. 1*a* and 5. The timer 221 for this purpose comprises an electrical input 225 which is connected to the switching button 223. The input signal $u_T$ is offered to a calculation unit 227 of the control unit 103, 191. The calculation unit 227 comprises a memory 229 in which the total shaving time of a number of preceding shaving operations, for example ten operations, is stored. The calculation unit 227 calculates an average shaving time of said preceding shaving operations. An output signal $u_{\%T}$ of the calculation unit 227 corresponds to the quotient of the time elapsed during a shaving operation (input signal $u_T$) and the calculated average shaving time.

The third electrical input signal $u_S$ is supplied by an operational member 231 shown in FIGS. 1*a* and 5 which is provided on the housing 3, 107 of the shaving apparatus 1, 105. By means of the operational member 231, the user of the shaving apparatus 1, 105 may set a balance desired by him between the shaving performance and the shaving comfort. The operational member 231 comprises a slide 233 for this purpose, which may be moved into any of a number of positions by the user.

The fourth electrical input signal $u_M$, finally, is supplied by a detector 235 which is capable of measuring a number of hairs cut by the cutting units 11, 121 per unit time (cutting frequency). The detector 235 for this purpose comprises a microphone 237 such as, for example, an electret microphone which is known per se and generally used, which is provided on the first intermediate plate 81, 175, as is evident from FIGS. 2 and 6. The microphone 237 supplies an acoustic signal $u_N$ which corresponds to the sound produced by the cutting units 11, 121 during the operation of cutting hairs offered through the hair trap openings 17. The acoustic signal $u_N$ is applied to an electrical filter 239, known per se and generally used, of the detector 235, which filters the cutting frequency (input signal $u_M$) from the acoustic signal $u_N$, i.e. the number of hairs cut by the cutting units 11, 121 per unit time.

As FIG. 10 shows, the control unit 103, 191 comprises a first sub-processor 241 which determines the first electrical output signal $u_H$ or $u_E$, as applicable, as a function of the first input signal $u_F$, and a first intermediate signal $u_D$ supplied by a second sub-processor 243 of the control unit 103, 191 and corresponding to an admissible skin deformation around the external cutting members 13, 123. An electrical filter 245 is furthermore connected between the first input 211 and the first sub-processor 241, filtering out comparatively short-period changes in the input signal $u_F$, so that the shaving apparatus 1, 105 does not react immediately to fast and transient changes in the skin contact force. The skin deformation around the external cutting members 13, 123 is determined in the case of shaving apparatus 1 by the value of the skin contact force and the height H of the external cutting members 13 above the holder 7, and in the case of shaving apparatus 105 by the value of the skin contact force and by the value of the pretensioning force of the blade spring 135. The skin deformation becomes greater when, given a constant skin contact force, the height H or the pretensioning force increases, or, given a constant height H or a constant pretensioning force, the skin contact force increases. The desired height H (output signal $u_H$) and the desired pretensioning force (output signal $u_E$) may thus be determined when the skin contact force and the admissible skin deformation are known. The first sub-processor 241 determines the output signal $u_H$, $u_E$ in accordance with a first control rule, therefore, according to which the desired height H or the desired pretensioning force (output signal $u_H$, $u_E$) decreases when the measured skin contact force (input signal $u_F$) increases, so that the skin deformation remains substantially constant, and according to which the desired height H or the pretensioning force (output signal $u_H$, $u_E$) increases at a constant skin contact force (input signal $u_F$) when the admissible skin deformation (intermediate signal $u_D$) increases. In the first embodiment of the shaving apparatus 1, the first sub-processor 241 has a further electrical input 242 which is connected to the switch button 223. The further input 242 is indicated with a broken line in FIG. 10. When the shaving apparatus 1 is switched off with the switching button 223, the control unit 103 and the actuator 91 bring the external cutting embers 13 into a position in which the external cutting members 13 are completely recessed in the holder 7 (H=0). In the switched-off state of the shaving apparatus 1, therefore, the cutting units 11 are less sensitive to damage, while in addition the switched-off state of the shaving apparatus 1 is better recognizable for the user of the shaving apparatus 1.

As FIG. 10 further shows, the second sub-processor 243 determines the first intermediate signal $u_D$ which corresponds to an admissible skin deformation as a function of a second intermediate signal $u_I$ supplied by a third sub-processor 247 and corresponding to a number of skin damage points admissible per unit time, and of the second output signal $u_R$ supplied by a fourth sub-processor 249. The number of skin damage points caused by the cutting units 11, 121 per unit time is determined in both shaving apparatuses 1, 105 by the skin deformation around the external cutting members 13, 123 and by the rotational speed of the internal cutting members 19, 125, which again is determined by the speed of motor 23, 127. The number of skin damage points caused per unit time increases when, at a constant motor speed, the skin deformation around the external cutting members 13, 123 increases, or when, at a constant skin deformation, the speed of the motor 23, 127 increases. The admissible skin deformation (intermediate signal $u_D$) can thus be determined when the speed of the motor 23, 127 and the admissible number of skin damage points per unit time are known. The second sub-processor 243 determines the intermediate signal $u_D$ in accordance with a second control rule, therefore, according to which the admissible skin deformation (intermediate signal $u_D$) decreases when the desired motor speed (output signal $u_R$) increases, so that the number of skin damage points caused per unit time remains substantially constant, and according to which the admissible skin deformation (intermediate signal $u_D$) at a constant desired motor speed (output signal $u_R$,) increases when the admissible number of skin damage points per unit time (intermediate signal $u_I$) increases.

As FIG. 10 further shows, the third sub-processor 247 determines the second intermediate signal $u_I$ which corresponds to an admissible number of skin damage points per unit time as a function of the output signal $u_{\%T}$ of the calculation unit 227 and of the third input signal $u_S$. The admissible number of skin damage points per unit time is determined by the balance desired by the user between the shaving performance and the shaving comfort, which shaving comfort depends not only on the number of skin damage points per unit time but also on the cumulative number of skin damage points during a shaving operation. When only a comparatively small number of skin damage points per unit time is allowed in an initial phase of the shaving operation, when the hairs are still comparatively long, so that the hairs are only shortened the first time, a comparatively great reserve is still present for yet admissible skin damage points in an end phase of the shaving operation, when the desired shaving performance (smoothness) is to be achieved in that the hairs are shortened further. The intermediate signal $u_I$ is determined by the sub-processor 247 in accordance with a third control rule, therefore, according to which the admissible number of skin damage points per unit time (intermediate signal $u_I$) increases with an increase in the time elapsed during a shaving operation (signal $u_{\%T}$), the increase in the admissible number of skin damage points per unit time (intermediate signal $u_I$) being comparatively small when the operational member 231 is placed in a position (C) in which the user desires a comparatively high shaving comfort and a comparatively low shaving performance, and being comparatively great when the operational member 231 is placed in a position (P) in which the user desires a comparatively low shaving comfort and a comparatively high shaving performance. Since the signal $u_{\%T}$ corresponds to the quotient of the time elapsed during a shaving operation and the average shaving time over a number of previous shaving operations, the admissible number of skin damage points per unit time (intermediate signal $u_I$) is so determined by the third sub-processor 247 that the user is given an optimum balance between shaving performance and shaving comfort, provided the shaving operation takes place in the average shaving time. An optimum balance between the shaving performance and the shaving comfort experienced is thus achieved both for users with a comparatively long average shaving time and for users with a comparatively short average shaving time.

As FIG. 10 further shows, the fourth sub-processor 249 determines the second output signal $u_R$ which corresponds to the desired speed of the motor 23, 127 as a function of the output signal $u_{\%T}$ of the calculation unit 227 and the fourth input signal $u_M$. Between the fourth input 217 and the fourth sub-processor 249 there is a further electrical filter 251 which filters comparatively short-period changes in the input signal $u_M$, so that the shaving apparatus 1, 105 does not react immediately to fast and transient changes in the measured cutting frequency. The desired motor speed is determined by the sub-processor 249 in accordance with a fourth control rule, according to which the desired motor speed (output signal $u_R$) increases with an increase in the measured cutting frequency (input signal $u_M$). When the cutting frequency is comparatively high, the internal cutting members 19, 125 are displaced relative to the external cutting members 13, 123 under the influence of cutting forces exerted on the internal cutting members 19, 125. Since the motor speed is comparatively high at comparatively high cutting frequencies, the internal cutting members 19, 125 have a comparatively high mechanical angular momentum at high cutting frequencies, so that the rotational movement of the internal cutting members 19, 125 is comparatively stable and displacements of the internal cutting members 19, 125 relative to the external cutting members 13, 123 under the influence of the cutting forces are limited as much as possible. In accordance with the fourth control rule, furthermore, the desired motor speed decreases as the time elapsed during a shaving operation increases, and the increase in the desired motor speed at a given increase in the cutting frequency is comparatively small when the elapsed time is short, and comparatively great when the elapsed time is long. This takes into account the wishes of users who shave a comparatively small portion of the skin smooth each time and subsequently shave an as yet unshaven portion of the skin, in which case the measured cutting frequency fluctuates strongly during the shaving operation.

Figure 11A:
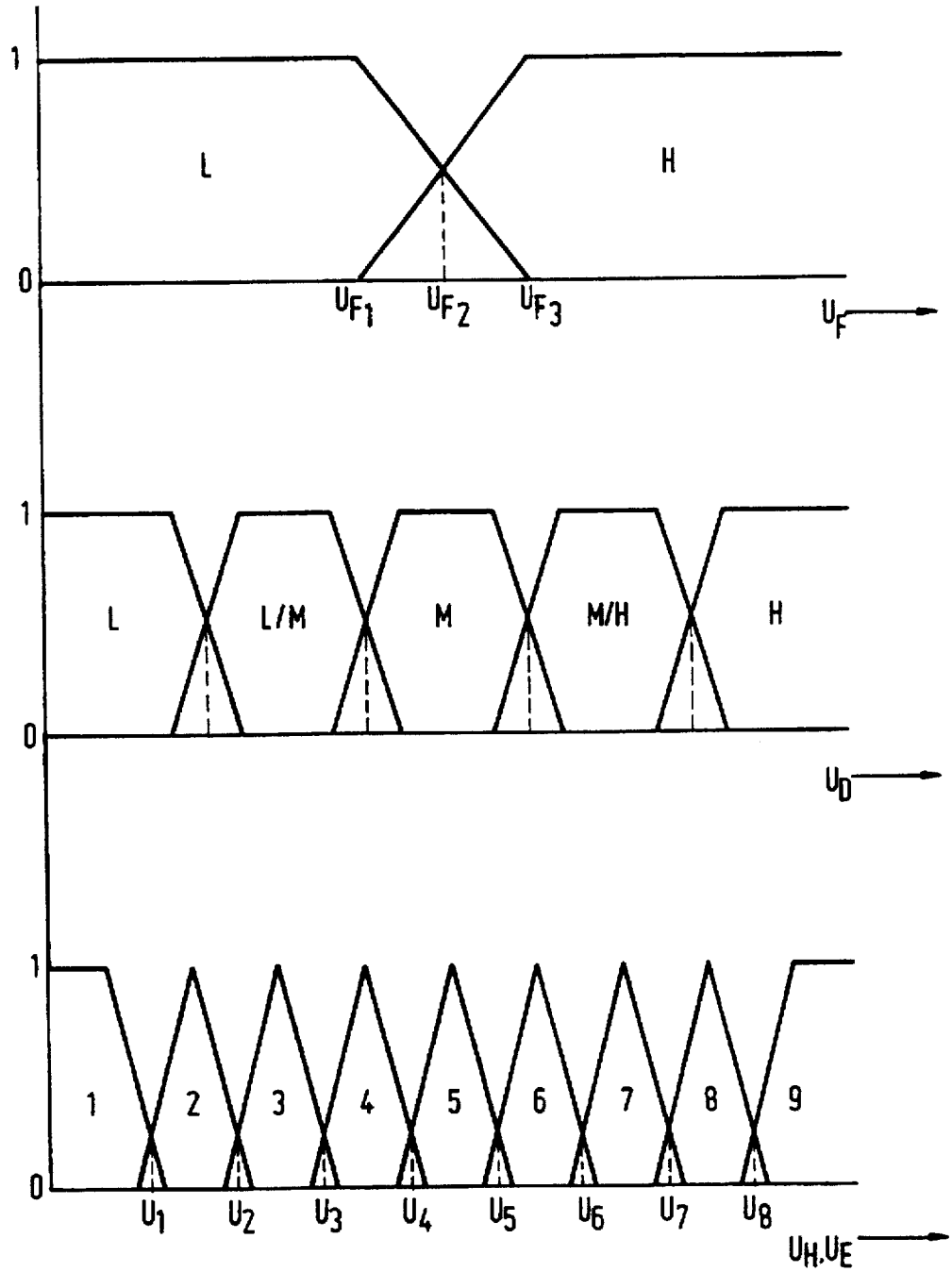

The four control rules mentioned, according to which the control unit 103, 191 determines the output signals $u_H$ or $u_E$, and $u_R$ as a function of the input signals $u_F$, $u_T$, $u_S$ and $u_M$ each comprise an algorithm based on so-called fuzzy logic. According to these algorithms, a range of each of the input signals and output signals of the relevant sub-processors 241, 243, 247, 249 is divided into a number of classes for each sub-processor 241, 243, 247 and 249 of the control unit 103, 191. FIGS. 11*a* to 11*d* show an embodiment of the classes into which the input signals and output signals of the respective sub-processors 241, 243, 247 and 249 are subdivided. As FIG. 11*a* shows, the input signal $u_F$ of the first sub-processor 241 is divided into the classes L (low) and H (high), while the intermediate signal $u_D$ is divided into the classes L (low), L/M (low to medium), M (medium), M/H (medium to high) and H (high). The output signal $u_H$ or $u_E$ is subdivided into classes 1 (smallest height H or pretensioning force) up to 9 (greatest height H or pretensioning force). Each of the signals $u_F$ and $u_D$ occurring during a shaving operation is continuously assigned a membership of one of the relevant classes by the sub-processor 241 in accordance with a membership function. The membership functions of the signals $u_F$ and $u_D$ are shown in FIG. 11*a*. The class to which the output signal $u_H$ or $u_E$ belongs during the shaving operation is determined by the sub-processor 241 in accordance with a logic rule as a function of the classes of the signals $u_F$ and $u_D$ determined in accordance with the membership functions. FIG. 12*a* shows a Table in which the class assigned to the output signal $u_H$ or $u_E$ in accordance with said logic rule is plotted as a function of the classes assigned to the signals $u_F$ and $u_D$. It is noted that FIG. 12*a* exclusively shows situations in which the signals $u_F$ and $u_D$ each belong to only one class according to the membership functions. However, the signals $u_F$ and $u_D$ may also belong to two classes. FIG. 11*a* shows, for example, that the signal $u_F$ belongs both to class L and to class H when the signal $u_F$ lies between the limit values $u_{F1}$ and $u_{F3}$. In these situations, too, the sub-processor 241 determines to which class or classes the output signal $u_H$ or $u_E$ belongs in a usual manner known per se from fuzzy logic. The sub-processor 241 determines the value of the output signal $u_H$ or $u_E$ in a usual manner known per se from fuzzy logic also when the output signal $u_H$ or $u_E$ belongs to two classes.

Figure 11B:
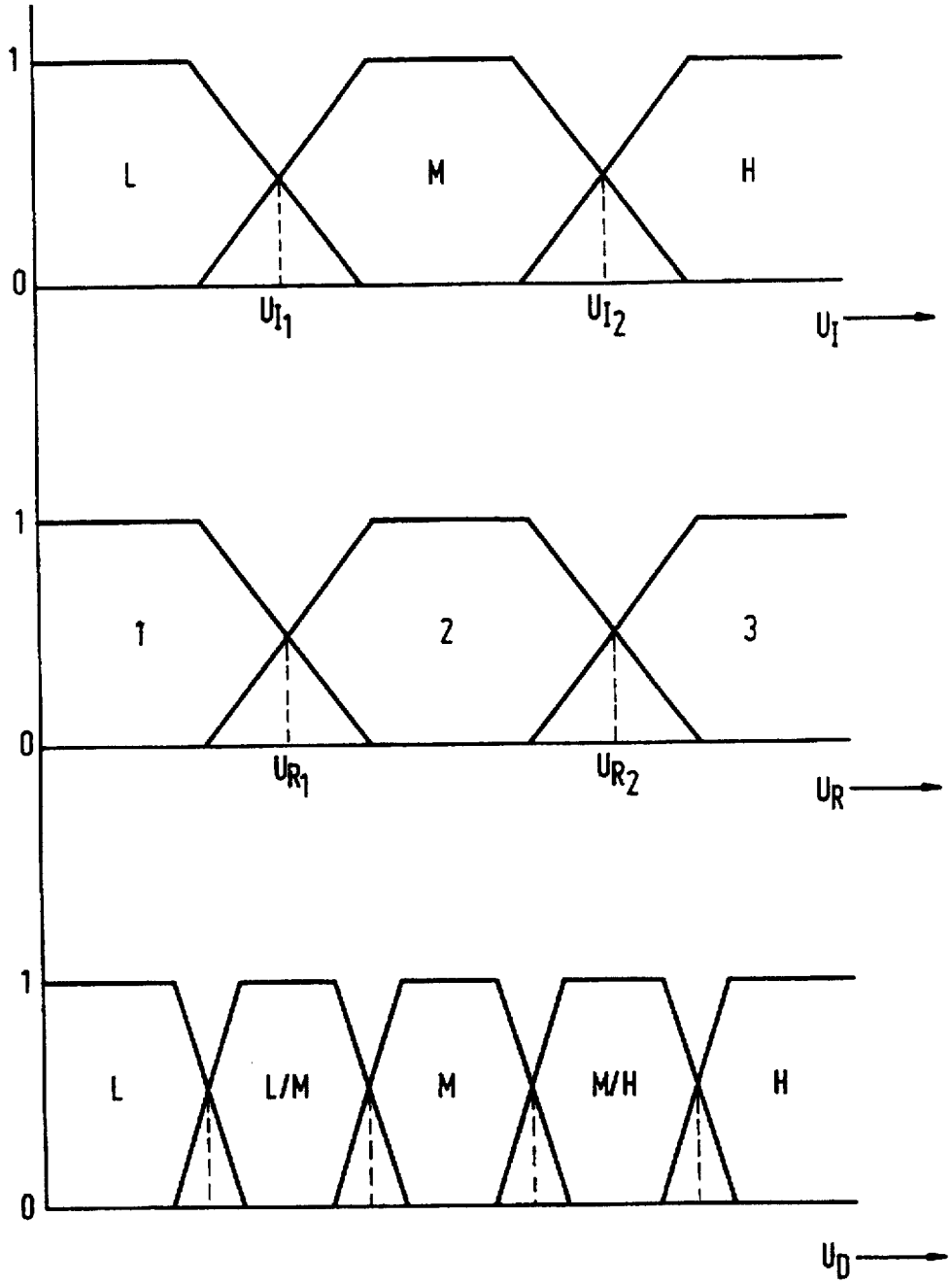

As FIG. 11*b* shows, the intermediate signal $u_I$, which forms an input signal for the second sub-processor 243, is divided into the classes L (low), M (medium), and H (high), while the output signal $u_R$, which also forms an input signal for the second sub-processor 243, is divided into classes 1 (low speed), 2 (medium speed), and 3 (high speed). FIG. 11*b* also shows the membership functions in accordance to which a membership of one of said classes is assigned to the signals $u_I$ and $u_R$. The membership function of the intermediate signal $u_D$, which forms an output signal of the second sub-processor 243, is identical to the membership function of the intermediate signal $u_D$ depicted in FIG. 11*a*. FIG. 12*b* is a Table in which the class assigned to the intermediate signal $u_D$ by the second sub-processor 243 is listed in relation to the classes assigned to the signals $u_I$ and $u_R$.

Figure 11C:
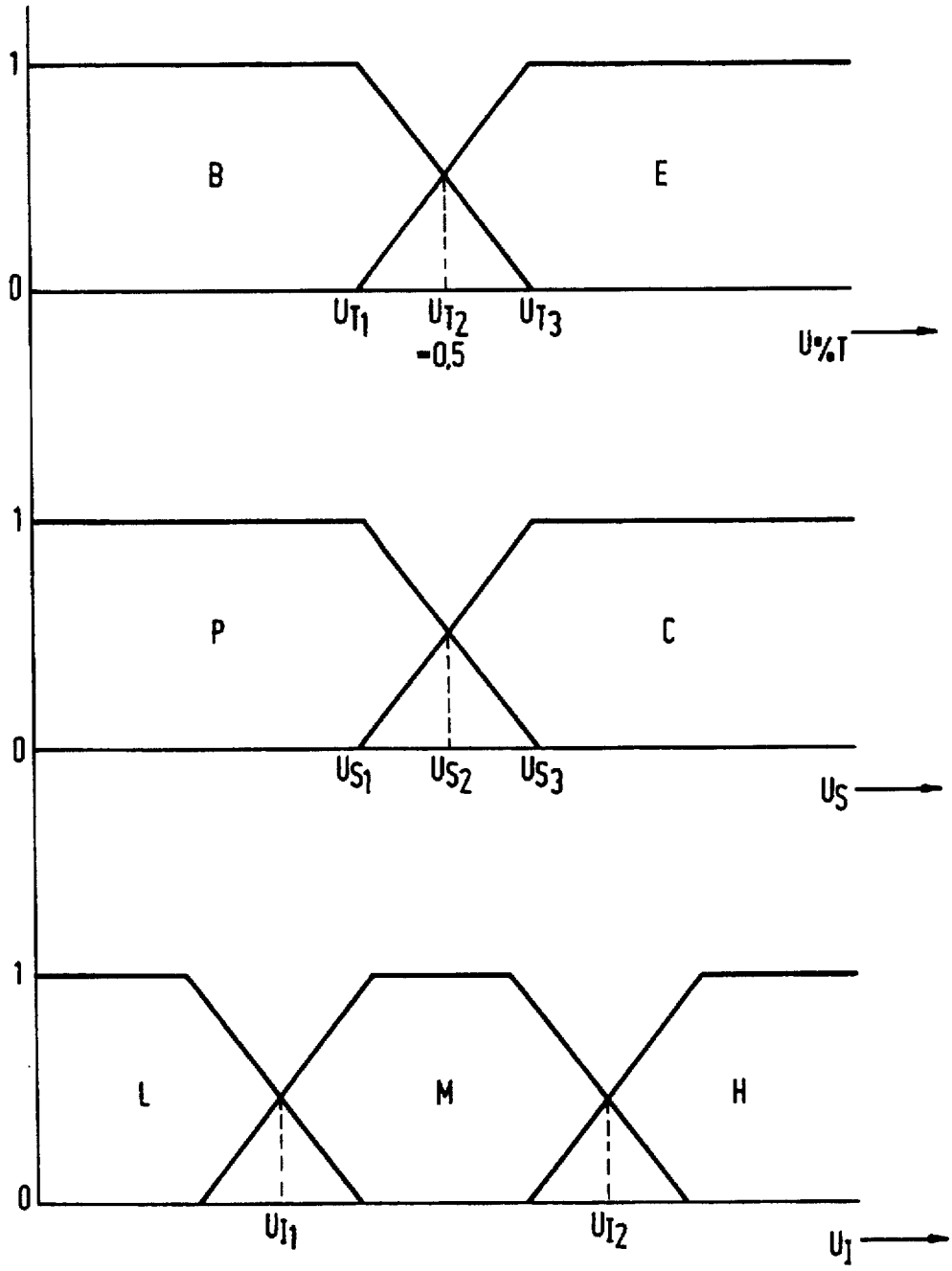

As FIG. 11*c* shows, the signal $u_{\%T}$, which forms an input signal for the third sub-processor 247, is divided into classes B (initial phase) and E (end phase), while the input signal $u_S$, which also forms an input signal for the third sub-processor 247, is divided into classes P (high shaving performance) and C (high shaving comfort). FIG. 11*c* also shows the membership functions in accordance with which a membership of one of said classes is assigned to the signals $u_{\%T}$ and $u_S$. The classes and membership function of the intermediate signal $u_I$, which forms an output signal of the third sub-processor 247, are identical to the classes and membership function of the intermediate signal $u_I$ shown in FIG. 11*b*. FIG. 12*c* is a Table in which the class assigned to the intermediate signal $u_I$ by the third sub-processor 247 is indicated in relation to the signals $u_{\%T}$ and $u_S$.

Figure 11D:
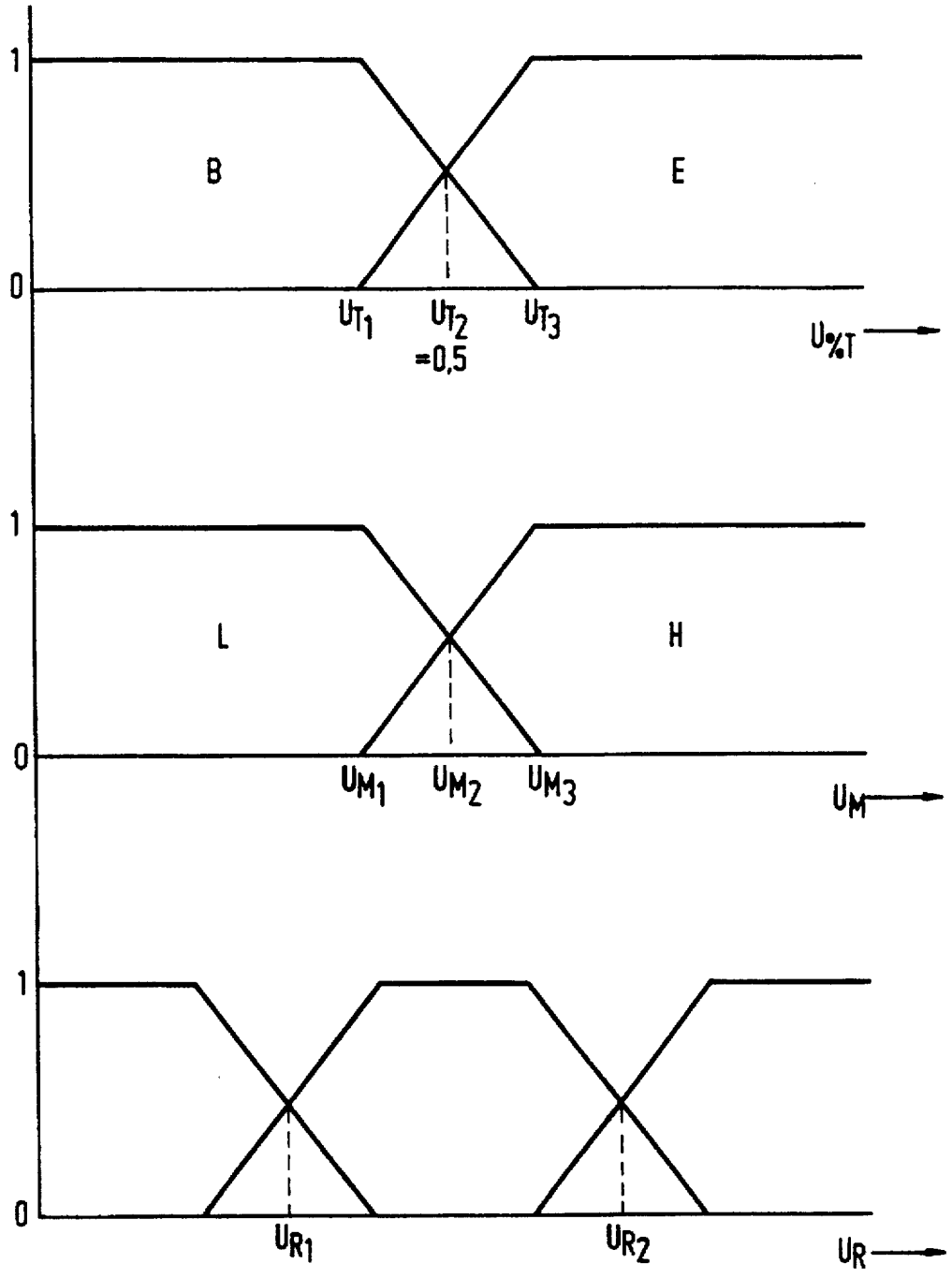

FIG. 11*d* finally shows that the input signal $u_M$, which is an input signal for the fourth sub-processor 249, is divided into classes L (low) and H (high). The classes and membership functions of the signal $u_{\%T}$, which also forms an input signal for the fourth sub-processor 249, and of the output signal $u_R$, which is an output signal of the fourth sub-processor 249, are identical to the respective classes and membership functions of the signals $u_{\%T}$ and $u_R$ shown in FIGS. 11*c* and 11*b*. FIG. 12*d* is a Table in which the class assigned to the output signal $u_R$ by the fourth sub-processor 249 is given as a function of the signals $u_{\%T}$ and $u_M$.

It is noted that the ranges of the input signals and output signals of the sub-processors 241, 243, 247, 249 may alternatively be subdivided into more classes than those described above, and that the sub-ranges of the classes may also be distributed differently. The desired behaviour of the shaving apparatus 1, 105 may be further refined thereby. The desired behaviour of the shaving apparatus 1, 105 may be laid down in a simple and visual manner in the control rules of the sub-processors 241, 243, 247, 249 owing to the use of said algorithms based on fuzzy logic. The desired behaviour of the shaving apparatus 1, 105 may in addition be changed in a simple and flexible manner during a design phase if the knowledge about the operation of the shaving apparatus 1, 105 or about characteristics of the user thereof should change.

It is noted that the shaving apparatuses 1, 105 described above are each provided with three external cutting members and three internal cutting members which are rotatable inside the external cutting members. The invention, however, is equally applicable to shaving apparatuses having an external cutting member and an internal cutting member which performs a vibratory or oscillatory movement relative to the external cutting member. The invention further also applies to shaving apparatuses comprising a different number of cutting units, for example, only one or two.

It is further noted that the height H of the cutting units 11 is adjustable in the first embodiment of the shaving apparatus 1, while in the second embodiment of the shaving apparatus 105 the pretensioning force of the cutting units 121 is adjustable. The invention is also applicable to shaving apparatuses with a cutting unit which is adjustable in a different manner and in which the shaving performance and shaving comfort are influenced by the adjustment of the cutting unit. Thus, for example, in the case of a shaving apparatus in which the external cutting member is a flexible foil with hair trap openings and in which the internal cutting member is a row of cutters oscillating along the foil, a contact force of the internal cutting member against the external cutting member may be adjustable by means of an actuator controlled by a control unit. Alternatively again, the contact force of the internal cutting member in the external cutting member may be adjustable by means of an actuator controllable by a control unit in a shaving apparatus which is provided with a rotatable internal cutting member, as are the shaving apparatuses 1, 105 described above.

It is further noted that the mechanical stiffness of the cutting units 121 may also be adjustable by means of a construction in which the flexible strips 151 bear continuously on the support elements 165 and in which the support elements 165 are movable along the flexible strips 151, whereby the mechanical stiffness of the strips 151 can be adjusted steplessly. Instead of the flexible strips 151, an alternative type of spring may be used, for example, in which the mechanical stiffness can be changed by a displacement or change in a clamping point of the spring.

It is finally noted that a different type of control unit compared with the control unit 103, 191 may be used for controlling the actuator 91, 197. Instead of a control unit based on control rules according to fuzzy logic, for example, control rules may be used based on usual mathematical equations. Furthermore, for example, alternative input signals may be used, or a different number of input signals, while also a different relation between the input signals and output signals may be chosen. Furthermore, for example, the control of the actuator 91, 179 may alternatively be used in a shaving apparatus in which the motor speed has a controlled, constant value or in which the voltage across or current through the motor is constant, and the motor speed depends on the load on the cutting units. In that case, the signal $u_R$ in FIG. 10 corresponds to the desired constant motor speed or to the measured actual motor speed, respectively.

We claim:

1. A shaving apparatus comprising an electric motor, at least one adjustable cutting unit provided with an external cutting member with at least one hair trap opening and an internal cutting member drivable relative to the external cutting member by means of said electric motor, an electrical actuator and an electrical control unit provided with at least one electrical input and at least one electrical output, characterized in that said cutting unit is adjustable by means of said actuator and said actuator is controllable by means of said electrical control unit.

2. A shaving apparatus as claimed in claim 1, provided with a holder in which the cutting unit is arranged and is displaceable by means of the actuator.

3. A shaving apparatus as claimed in claim 2, characterized in that the actuator places the cutting unit in a rest position, in which the cutting unit is recessed in the holder, when the electric motor is switched off.

4. A shaving apparatus as claimed in claim 2, wherein the external cutting member is displaceable relative to the holder by means of the actuator, while the internal cutting member is held in the external cutting member under the influence of a pretensioning force of an elastically deformable element provided in said apparatus.

5. A shaving apparatus as claimed in claim 4, wherein the external cutting member of the cutting unit is fastened to a displaceable carrier provided in said apparatus which carrier is coupled to an adjustment member provided in said apparatus which member is rotatable relative to the holder by means of the actuator, the carrier being displaceable through a rotation of the adjustment member.

6. A shaving apparatus as claimed in claim 2, wherein the electrical control unit has an electrical input which is connected to an electrical output of a position sensor provided in said apparatus which sensor is capable of measuring a position of the cutting unit relative to the holder.

7. A shaving apparatus as claimed in claim 5 wherein the position sensor is capable of measuring an angle of rotation of the adjustment member relative to the holder.

8. A shaving apparatus as claimed in claim 1, wherein a holder is provided in said apparatus and said cutting unit is arranged in the holder and is displaceable relative to the holder against a pretensioning force which has a value which is adjustable by means of the actuator.

9. A shaving apparatus as claimed in claim 8, wherein the pretensioning force is exerted by an elastically deformable element provided in said apparatus which element has a mechanical stiffness which is adjustable by means of the actuator.

10. A shaving apparatus as claimed in claim 9, characterized in that the elastically deformable element is coupled to the external cutting member, while the internal cutting member is held in the external cutting member under the influence of a pretensioning force of a further elastically deformable element provided in said apparatus.

11. A shaving apparatus as claimed in claim 9, wherein the elastically deformable element is a mechanical blade spring which can be supported by a support element provided in said apparatus which element is displaceable by means of the actuator.

12. A shaving apparatus as claimed in claim 11, wherein the support element cooperates with the cutting unit and is provided on a displaceable carrier provided in said apparatus which carrier is coupled to an adjustment member which adjustment member is rotatable relative to the holder by means of the actuator, the carrier being displaceable through a rotation of the adjustment member.

13. A shaving apparatus as claimed in claim 8, wherein the electrical control unit has an electrical input which is connected to an electrical output of a sensor provided in said apparatus and which sensor is capable of measuring the pretensioning force of the cutting unit.

14. A shaving apparatus as claimed in claims 12 wherein an angle of rotation of the adjustment member relative to the holder is measurable by means of the sensor provided in said apparatus, while a further electrical input of the control unit is connected to an electrical output of a further sensor capable of measuring a position of the cutting unit relative to the holder.

15. A shaving apparatus as claimed in claim 14, characterized in that the further sensor is a strain gauge sensor by means of which a deformation of a spring fastened between the external cutting member and the holder is measurable.

16. A shaving apparatus as claimed in claim 1 wherein the electric motor has a speed which is controllable by means of the electrical control unit.

17. A shaving apparatus as claimed in claim 16 wherein the electrical control unit has an electrical input of an operational member provided in said apparatus and with which operational member a desired balance between shaving performance and shaving comfort can be set.

18. A shaving apparatus as claimed in claim 16 wherein the electrical control unit has an electrical input which is connected to an electrical output of a timer provided in said apparatus and which timer is capable of measuring a time which has elapsed during a shaving operation.

19. A shaving apparatus as claimed in claim 18, characterized in that the control unit is provided with a calculation unit for calculating an average shaving time over a number of previous shaving operations, the control unit determining the time which has elapsed during a shaving operation in relation to the calculated average shaving time.

20. A shaving apparatus as claimed in claim 1 wherein the electrical control unit has an electrical input which is connected to an electrical output of a detector provided in said apparatus and which detector is capable of measuring a number of hairs cut by the cutting unit per unit of time.

21. A shaving apparatus as claimed in claim 20, characterized in that the detector is provided with a microphone capable of detecting an acoustic signal produced by the cutting unit, and with an electrical falter capable of filtering a cutting frequency from the acoustic signal.

22. A shaving apparatus as claimed in claim 1 wherein the electrical control unit has an electrical input which is connected to an electrical output of a force sensor provided in said apparatus and which force sensor is capable of measuring a skin contact force exerted on the cutting line.

23. A shaving apparatus as claimed in claim 5 wherein the force sensor comprises a strain gauge sensor which is provided on an elastically deformable bridge, while the rotatable adjustment member rests on the bridge in a direction parallel to a force to be measured and has a mechanical stiffness in said direction which is comparatively small compared with a mechanical stiffness which the bridge has in said direction.

24. A shaving apparatus as claimed in claim 13 wherein the force sensor by which the skin contact force can be measured is the sensor by which the pretensioning force of the cutting unit can be measured.

25. A shaving apparatus as claimed in claim 22 wherein characterized in that the electrical control unit is provided with means for controlling the electrical actuator, with a first electrical input which is connected to an electrical output of the force sensor, a second electrical input which is connected to the electrical output of the timer, a third electrical input which is connected to the electrical output of the operational member, a fourth electrical input which is connected to the electrical output of the detector, and an electrical output for supplying an output signal which corresponds to a desired position of the cutting unit above the holder or a desired value of the pretensioning force of the cutting unit.

26. A shaving apparatus as claimed in claim 25, characterized in that said means determine the output signal in accordance with a first control rule according to which the desired position above the holder or the pretensioning force decreases when the measured skin contact force increases, and the desired position above the holder or the pretensioning force increases when an admissible skin deformation around the cutting unit increases, while said means determine the admissible skin deformation in accordance with a second control rule.

27. A shaving apparatus as claimed in claim 26, characterized in that, in accordance with the second control rule, the admissible skin deformation decreases when a desired speed of the motor increases, and the admissible skin deformation increases when an admissible number of skin damage points per unit time increases, while said means determine the admissible number of skin damage points per unit time in accordance with a third control rule and the desired motor speed in accordance with a fourth control rule.

28. A shaving apparatus as claimed in claim 27, characterized in that, in accordance with the third control rule, the admissible number of skin damage points per unit time increases with an increase in the time which has elapsed during a shaving operation, the increase in the admissible number of skin damage points per unit time being comparatively small if the operational member is in a position in which a user of the shaving apparatus wishes a comparatively high shaving comfort and comparatively low shaving performance, and being comparatively great if the operational member is in a position in which a user of the shaving apparatus desires a comparatively low shaving comfort and comparatively high shaving performance.

29. A shaving apparatus as claimed in claim 27, characterized in that, according to the fourth control rule, the desired motor speed increases with an increase in the measured number of hairs cut by the cutting unit per unit time, the desired motor speed decreases when the time which has elapsed during a shaving operation increases, and the increase in the desired motor speed with an increase in the measured number of hairs cut by the cutting unit per unit time is comparatively small if the elapsed time is short, and is comparatively great if the elapsed time is long.

30. A shaving apparatus as claimed in claim 16 wherein said means are provided with a further electrical output for supplying a further output signal which corresponds to the desired motor speed determined in accordance with the fourth control rule.

31. A shaving apparatus as claimed in claim 20 wherein the electrical control unit is provided with means for controlling the speed of the electric motor, with a first electrical input connected to the electrical output of the timer, a second electrical input connected to the electrical output of the detector, and an electrical output for supplying an output signal which corresponds to a desired motor speed and which is determined by a control rule.

32. A shaving apparatus as claimed in claim 31, characterized in that, in accordance with the control rule, the desired motor speed increases with an increase in the measured number of hairs cut by the curing unit per unit time, the desired motor speed decreases as the time elapsed during a shaving operation increases, and the increase in the desired motor speed with an increase in the measured number of hairs cut by the curing unit per unit time is comparatively small if the elapsed time is short, and comparatively great if the elapsed time is long.

33. A shaving apparatus as claimed in claim 26 wherein the control rules determine the output signal in accordance with an algorithm based on fuzzy logic.

34. A shaving apparatus as claimed in claim 31 wherein the control rule determines the output signal in accordance with an algorithm based on fuzzy logic.

35. A shaving apparatus as claimed in claim 3 wherein the external cutting member is displaceable relative to the holder by means of the actuator, while the internal cutting member is held in the external cutting member under the influence of a pretensioning force of an elastically deformable element provided in said apparatus.

36. A shaving apparatus as claimed in claim 3 wherein the electrical control unit has an electrical input and connected to an electrical output of a position sensor which is capable of measuring a position of the cutting unit relative to the holder.

37. A shaving apparatus as claimed in claim 4 the electrical control unit has an electrical input which is connected to an electrical output of a position sensor which is capable of measuring a position of the cutting unit relative to the holder.

38. A shaving apparatus as claimed in claim 5 the electrical control unit has an electrical input which is connected to an electrical output of a position sensor and capable of measuring a position of the cutting unit relative to the holder.

39. A shaving apparatus as claimed in claim 6 wherein the position sensor is capable of measuring an angle of rotation of the adjustment member relative to the holder.

40. A shaving apparatus as claimed in claim 10 wherein the elastically deformable element is a mechanical blade spring which can be supported by a support element which is displaceable by means of the actuator.

41. A shaving apparatus as claimed in claim 9 wherein the electrical control unit has an electrical input which is connected to an electrical output of a sensor capable of measuring the pretensioning force of the cutting unit.

42. A shaving apparatus as claimed in claim 10 wherein the electrical control unit has an electrical input which is connected to an electrical output of a sensor provided in said apparatus capable of measuring the pretensioning force of the cutting unit.

43. A shaving apparatus as claimed in claim 11 wherein the electrical control unit has an electrical input which is connected to an electrical output of a sensor provided in said apparatus capable of measuring the pretensioning force of the cutting unit.

44. A shaving apparatus as claimed in claim 12 wherein the electrical control unit has an electrical input which is connected to an electrical output of a sensor provided in said apparatus capable of measuring the pretensioning force of the cutting unit.

45. A shaving apparatus as claimed in claim 13 wherein an angle of rotation of the adjustment member relative to the holder is measurable by means of the sensor, while a further electrical input of the control unit is connected to an electrical output of a further sensor provided in said apparatus capable of measuring a position of the cutting unit relative to the holder.

46. A shaving apparatus as claimed in claim 22 wherein the force sensor comprises a strain gauge sensor which is provided on an elastically deformable bridge, while the rotatable adjustment member rests on the bridge in a direction parallel to a force to be measured and has a mechanical stiffness in said direction which is comparatively small compared with a mechanical stiffness which the bridge has in said direction.

47. A shaving apparatus as claimed in claim 12 wherein the force sensor comprises a strain gauge sensor which is provided on an elastically deformable bridge, while the rotatable adjustment member rests on the bridge in a direction parallel to a force to be measured and has a mechanical stiffness in said direction which is comparatively small compared with a mechanical stiffness which the bridge has in said direction.

48. A shaving apparatus as claimed in claim 13 wherein the force sensor by which the skin contact force can be measured the sensor by which the pretensioning force of the cutting unit can be measured.

49. A shaving apparatus as claimed in claim 22 wherein the force sensor by which the skin contact force can be measured is the sensor by which the pretensioning force of the cutting unit can be measured.

50. A shaving apparatus as claimed in claim 23 wherein the electrical control unit is provided with means for controlling the electrical actuator, with a first electrical input which is connected to an electrical output of the force sensor, a second electrical input which is connected to the electrical output of the timer, a third electrical input which is connected to the electrical output of the operational member, a fourth electrical input which is connected to the electrical output of the detector, and an electrical output for supplying an output signal which corresponds to a desired position of the cutting unit above the holder or a desired value of the pretensioning force of the cutting unit.

51. A shaving apparatus as claimed in claim 24 wherein the electrical control unit is provided with means for controlling the electrical actuator, with a first electrical input which is connected to an electrical output of the force sensor, a second electrical input which is connected to the electrical output of the timer, a third electrical input which is connected to the electrical output of the operational member, a fourth electrical input which is connected to the electrical output of the detector, and an electrical output for supplying an output signal which corresponds to a desired position of the cutting unit above the holder or a desired value of the pretensioning force of the cutting unit.

52. A shaving apparatus as claimed in claim 27 wherein said means are provided with a further electrical output for supplying a further output signal which corresponds to the desired motor speed determined in accordance with the fourth control rule.

53. A shaving apparatus as claimed in claim 28 wherein said means are provided with a further electrical output for supplying a further output signal which corresponds to the desired motor speed determined in accordance with the fourth control rule.

54. A shaving apparatus as claimed in claim 29 wherein said means are provided with a further electrical output for supplying a further output signal which corresponds to the desired motor speed determined in accordance with the fourth control rule.

55. A shaving apparatus as claimed in claim 21 wherein the electrical control unit is provided with means for controlling the speed of the electric motor, with a first electrical input connected to the electrical output of the timer, a second electrical input connected to the electrical output of the detector, and an electrical output for supplying an output signal which corresponds to a desired motor speed and which is determined by a control rule.

56. A shaving apparatus as claimed in claim 27 wherein the control rules determine the output signal in accordance with an algorithm based on fuzzy logic.

57. A shaving apparatus as claimed in claim 28 wherein the control rules determine the output signal in accordance with an algorithm based on fuzzy logic.

58. A shaving apparatus as claimed in claim 29 wherein the control rules determine the output signal in accordance with an algorithm based on fuzzy logic.

59. A shaving apparatus as claimed in claim 32 wherein the control rule determines the output signal in accordance with an algorithm based on fuzzy logic.

* * * * *